US008335583B2

(12) United States Patent
Katano

(10) Patent No.: US 8,335,583 B2
(45) Date of Patent: Dec. 18, 2012

(54) EMBROIDERY DATA GENERATING DEVICE AND COMPUTER-READABLE MEDIUM STORING EMBROIDERY DATA GENERATING PROGRAM

(75) Inventor: Tomotaka Katano, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 439 days.

(21) Appl. No.: 12/659,406

(22) Filed: Mar. 8, 2010

(65) Prior Publication Data

US 2010/0234979 A1 Sep. 16, 2010

(30) Foreign Application Priority Data

Mar. 13, 2009 (JP) ..... 2009-060615

(51) Int. Cl.
*D05C 5/02* (2006.01)

(52) U.S. Cl. ..... 700/138; 112/470.01

(58) Field of Classification Search ..... 700/136–138; 112/102.5, 470.01, 470.06, 475.18, 475.19
See application file for complete search history.

(56) References Cited

U.S. PATENT DOCUMENTS

| | | | | |
|---|---|---|---|---|
| 4,991,524 | A * | 2/1991 | Ozaki | 112/102.5 |
| 6,004,018 | A | 12/1999 | Kawasato et al. | |
| 6,324,441 | B1 * | 11/2001 | Yamada | 700/138 |
| 6,370,442 | B1 * | 4/2002 | Wang | 700/138 |

FOREIGN PATENT DOCUMENTS

| | | |
|---|---|---|
| JP | A-02-221453 | 9/1990 |
| JP | A-2-237592 | 9/1990 |
| JP | A-09-241963 | 9/1997 |

OTHER PUBLICATIONS

Foreign Office Action mailed Mar. 15, 2011 in Japanese Application No. 2009-060615 (with translation).

* cited by examiner

*Primary Examiner* — Nathan Durham
(74) *Attorney, Agent, or Firm* — Oliff & Berridge, PLC

(57) ABSTRACT

An embroidery data generating apparatus that generates embroidery data for an embroidery pattern includes a boundary line acquisition device that acquires boundary line data that is data that specifies a boundary line that surrounds a closed region, a unit area arrangement device that contiguously arranges first unit areas over the entire closed region, each of the first unit areas being a rectangular area that includes a unit line segment, a coverage rate computation device that computes a coverage rate that is a ratio of the closed region in each of the first unit areas, a determination device that determines whether a stitch will be formed on the unit line segment in each of the first unit areas, based on the coverage rate, and an embroidery data generating device that generates the embroidery data for the embroidery pattern that is formed by the cross-stitches.

6 Claims, 32 Drawing Sheets

FIG. 6

| NUMBER OF QUARTER CROSS-STITCHES | CROSS-STITCH STITCHING PATTERN |
|---|---|
| 0 | |
| 1 | |
| 2 | |
| 3 | |
| 4 | |

FIG. 11

51

| CROSS AREA NO. | VERTEX | X COORDINATE | Y COORDINATE |
|---|---|---|---|
| 0 | A | $X_{0A}$ | $Y_{0A}$ |
| | B | $X_{0B}$ | $Y_{0B}$ |
| | C | $X_{0C}$ | $Y_{0C}$ |
| | D | $X_{0D}$ | $Y_{0D}$ |
| 1 | A | $X_{1A}$ | $Y_{1A}$ |
| | B | $X_{1B}$ | $Y_{1B}$ |
| | C | $X_{1C}$ | $Y_{1C}$ |
| | D | $X_{1D}$ | $Y_{1D}$ |
| ⋮ | ⋮ | ⋮ | ⋮ |

FIG. 12

52

| | | m | | | | |
|---|---|---|---|---|---|---|
| | | 0 | 1 | 2 | 3 | ··· |
| n | 0 | 0 | 1 | 2 | 3 | ··· |
| | 1 | 11 | 12 | 13 | 14 | ··· |
| | 2 | 22 | 23 | 24 | 25 | ··· |
| | 3 | 33 | 34 | 35 | 36 | ··· |
| | ⋮ | ⋮ | ⋮ | ⋮ | ⋮ | ⋮ |

FIG. 13

53

| CROSS AREA NO. | DIVIDED AREA NO. | VERTEX | X COORDINATE | Y COORDINATE | STITCH FLAG |
|---|---|---|---|---|---|
| 1 | 0 | a | $X_{10a}$ | $Y_{10a}$ | OFF |
| | | b | $X_{10b}$ | $Y_{10b}$ | |
| | | c | $X_{10c}$ | $Y_{10c}$ | |
| | | d | $X_{10d}$ | $Y_{10d}$ | |
| | 1 | a | $X_{11a}$ | $Y_{11a}$ | OFF |
| | | b | $X_{11b}$ | $Y_{11b}$ | |
| | | c | $X_{11c}$ | $Y_{11c}$ | |
| | | d | $X_{11d}$ | $Y_{11d}$ | |
| ⋮ | ⋮ | ⋮ | ⋮ | ⋮ | ⋮ |

FIG. 22

C1
|
C2
|
C3
|
C4
|
C7
|
C6
|
C5

FIG. 29

61

| DIVIDED AREA NO. | VERTEX | X COORDINATE | Y COORDINATE | STITCH FLAG 1 | STITCH FLAG 2 |
|---|---|---|---|---|---|
| 0 | a | $X_{10a}$ | $Y_{10a}$ | OFF | OFF |
| | b | $X_{10b}$ | $Y_{10b}$ | | |
| | c | $X_{10c}$ | $Y_{10c}$ | | |
| | d | $X_{10d}$ | $Y_{10d}$ | | |
| 1 | a | $X_{11a}$ | $Y_{11a}$ | OFF | OFF |
| | b | $X_{11b}$ | $Y_{11b}$ | | |
| | c | $X_{11c}$ | $Y_{11c}$ | | |
| | d | $X_{11d}$ | $Y_{11d}$ | | |
| ⋮ | ⋮ | ⋮ | ⋮ | ⋮ | ⋮ |

FIG. 30

62

| | | i | | | | |
|---|---|---|---|---|---|---|
| | | 0 | 1 | 2 | 3 | ··· |
| j | 0 | 0 | 1 | 2 | 3 | ··· |
| | 1 | 22 | 23 | 24 | 25 | ··· |
| | 2 | 44 | 45 | 46 | 47 | ··· |
| | 3 | 66 | 67 | 68 | 69 | ··· |
| | ⋮ | ⋮ | ⋮ | ⋮ | ⋮ | ⋮ |

EMBROIDERY DATA GENERATING DEVICE AND COMPUTER-READABLE MEDIUM STORING EMBROIDERY DATA GENERATING PROGRAM

CROSS REFERENCE TO RELATED APPLICATION

This application claims priority to Japanese Patent Application No. 2009-060615, filed Mar. 13, 2009, the content of which is hereby incorporated herein by reference in its entirety.

BACKGROUND

The present disclosure relates to an embroidery data generating device and a computer-readable medium that stores an embroidery data generating program that generate embroidery data for an embroidery pattern that is formed by a plurality of cross-stitches.

An embroidery technique called cross-stitching is known. A cross-stitch may be configured from two stitches that intersect one another at their centers to form an X shape. A desired form may be expressed by arranging a plurality of cross-stitches on a work cloth. A device is also known that generates embroidery data for an embroidery sewing machine to sew an embroidery pattern that is formed from a plurality of cross-stitches of this sort. This sort of embroidery data generating device, for example, divides an image that serves as the basis for the embroidery pattern into grid cells each of which is of a size that corresponds to a cross-stitch. Then, for each of the cells, a determination is made as to whether a cross-stitch will be formed in the cell, based on a percentage of the cell that is covered by the image.

SUMMARY

The known embroidery data generating device that is described above determines whether or not to form a cross-stitch in each of the cells whose size corresponds to the cross-stitch. This means that, in each of the cells, either an X-shaped cross-stitch is formed or no stitch is formed at all. Therefore, a contour line of the embroidered shape may be jagged as the contour line follows a boundary line of the cells in the grid. In an area that is close to the contour line of the form of the original image, a cross-stitch may be formed that deviates from the contour line. In particular, in a case where the contour line separates from the boundary line of the cells in the grid, and in a case where the contour line extends in a different direction from a direction of the boundary line, it may be not possible to convert the contour line into embroidery data that faithfully expresses the profile of the form of the original image. This may cause the finished state of the embroidery to be inferior.

Various exemplary embodiments of the broad principles derived herein provide an embroidery data generating device and a computer-readable medium that stores an embroidery data generating program that generate embroidery data that faithfully express a profile of an original form.

Exemplary embodiments provide an embroidery data generating apparatus that generates embroidery data for an embroidery pattern. The embroidery data generating apparatus includes a boundary line acquisition device that acquires boundary line data that is data that specifies a boundary line that surrounds a closed region that has a shape, and a unit area arrangement device that contiguously arranges first unit areas over the entire closed region that is specified by the boundary line data that is acquired by the boundary line acquisition device, each of the first unit areas being a rectangular area that is obtained by dividing a second unit area into fourths and that includes a unit line segment as a diagonal line of the rectangular area, the second unit area being a rectangular area in which two line segments that intersect one another at a midpoint of each of the two line segments serve as diagonal lines and defining an area for a cross-stitch, the unit line segment extending from an intersection of the two line segments to one of endpoints of the two line segments. The embroidery data generating apparatus also includes a coverage rate computation device that computes a coverage rate that is a ratio of the closed region in each of the first unit areas that are arranged by the unit area arrangement device, a determination device that determines whether a stitch will be formed on the unit line segment in each of the first unit areas, based on the coverage rate that is computed by the coverage rate computation device, and an embroidery data generating device that generates the embroidery data for the embroidery pattern that is formed by the cross-stitches based on a determination by the determination device, each of the cross-stitches including at least one stitch formed on at least one of the unit line segments included in four of the first unit areas obtained from the same second unit area.

Exemplary embodiments also provide a computer-readable medium storing an embroidery data generating program that generates embroidery data for an embroidery pattern. The program includes instructions that cause a computer to perform the steps of acquiring boundary line data that is data that specifies a boundary line that surrounds a closed region that has a shape, and arranging contiguously first unit areas over the entire closed region that is specified by the acquired boundary line data, each of the first unit areas being a rectangular area that is obtained by dividing a second unit area into fourths and that includes a unit line segment as a diagonal line of the rectangular area, the second unit area being a rectangular area in which two line segments that intersect one another at a midpoint of each of the two line segments serve as diagonal lines and defining an area for a cross-stitch, the unit line segments extending from an intersection of the two line segments to one of endpoints of the two line segments. The program also includes instructions that cause the computer to perform the steps of computing a coverage rate that is a ratio of the closed region in each of the arranged first unit areas, determining whether a stitch will be formed on the unit line segment in each of the first unit areas, based on the computed coverage rate, and generating the embroidery data for the embroidery pattern that is formed by the cross-stitches based on a determination of whether a stitch will be formed on the unit line segment in each of the first unit areas, each of the cross-stitches including at least one stitch formed on at least one of the unit line segments included in four of the first unit areas obtained from the same second unit area.

Exemplary embodiments further provide an embroidery data generating apparatus that generates embroidery data for an embroidery pattern. The embroidery data generating apparatus includes boundary line acquisition means for acquiring boundary line data that is data that specifies a boundary line that surrounds a closed region that has a shape, and unit area arrangement means for contiguously arranging first unit areas over the entire closed region that is specified by the boundary line data that is acquired by the boundary line acquisition means, each of the first unit areas being a rectangular area that is obtained by dividing a second unit area into fourths and that includes a unit line segment as a diagonal line of the rectangular area, the second unit area being a rectangular area in which two line segments that intersect one another at a midpoint of each of the two line segments serve as diagonal lines and defining an area for a cross-stitch, the unit line segment extending from an intersection of the two line segments to one of endpoints of the two line segments. The embroidery data generating apparatus also includes coverage rate computation means for computing a coverage rate that is a ratio of the closed region in each of the first unit areas that are arranged by the unit area arrangement means, determination means for determining whether a stitch will be formed on the unit line segment in each of the first unit areas, based on the coverage rate that is computed by the coverage rate computation means, and embroidery data generating means for generating the embroidery data for the embroidery pattern that is formed by the cross-stitches based on a determination by the determination means, each of the cross-stitches including at least one stitch formed on at least one of the unit line segments included in four of the first unit areas obtained from the same second unit area.

BRIEF DESCRIPTION OF THE DRAWINGS

Exemplary embodiments will be described below in detail with reference to the accompanying drawings in which:

FIG. 6 is an explanatory figure of a cross-stitch stitching pattern that is used in an embodiment of the present disclosure;

FIG. 11 is an explanatory figure of a cross area coordinates table;

FIG. 12 is an explanatory figure of a cross area arrangement table;

FIG. 13 is an explanatory figure of a divided areas table;

FIG. 22 is an explanatory figure of a tree structure of the cross areas C1 to C7;

FIG. 29 is an explanatory figure of a divided areas table according to the other embodiment;

FIG. 30 is an explanatory figure of a divided areas arrangement table according to the other embodiment;

DETAILED DESCRIPTION

Hereinafter, embodiments of the present disclosure will be explained with reference to the drawings. The drawings are used to explain technological features that the present disclosure may utilize, and a configuration of a device, flowcharts of various types of processing, and the like which is described do not limit the present disclosure to only that configuration, that processing, and the like, but are merely explanatory examples.

Figure 1:
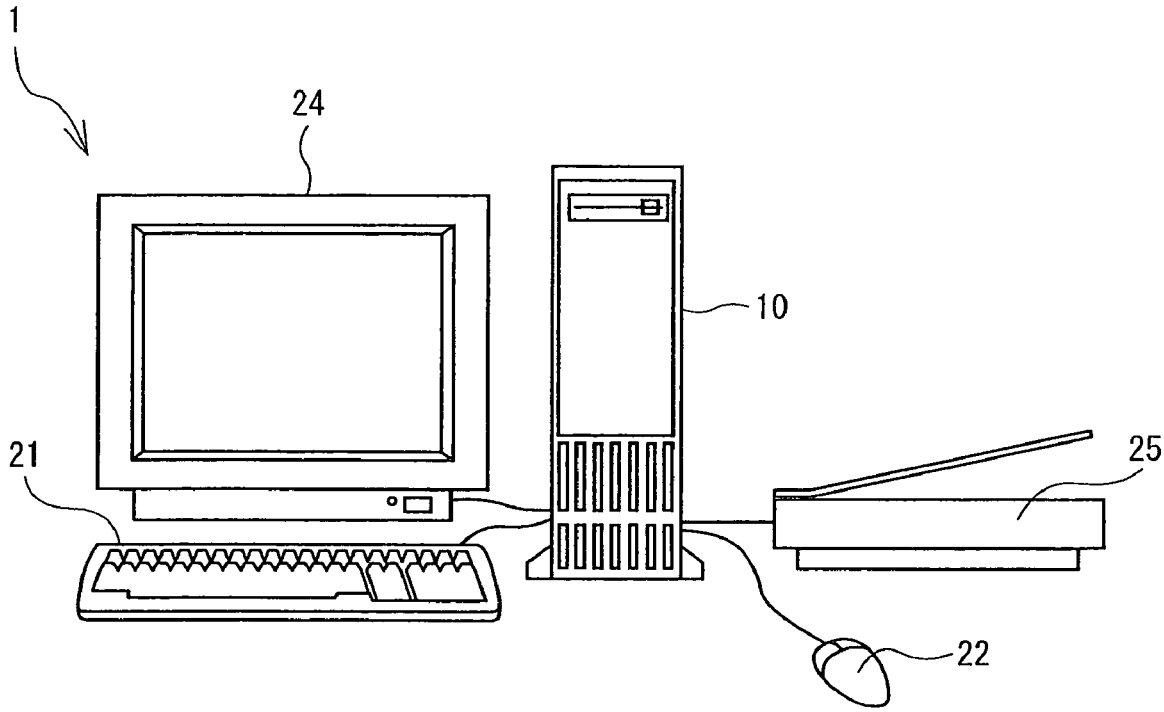
FIG. 1 is an overall configuration diagram that shows a physical configuration of an embroidery data generating device.
Figure 2:
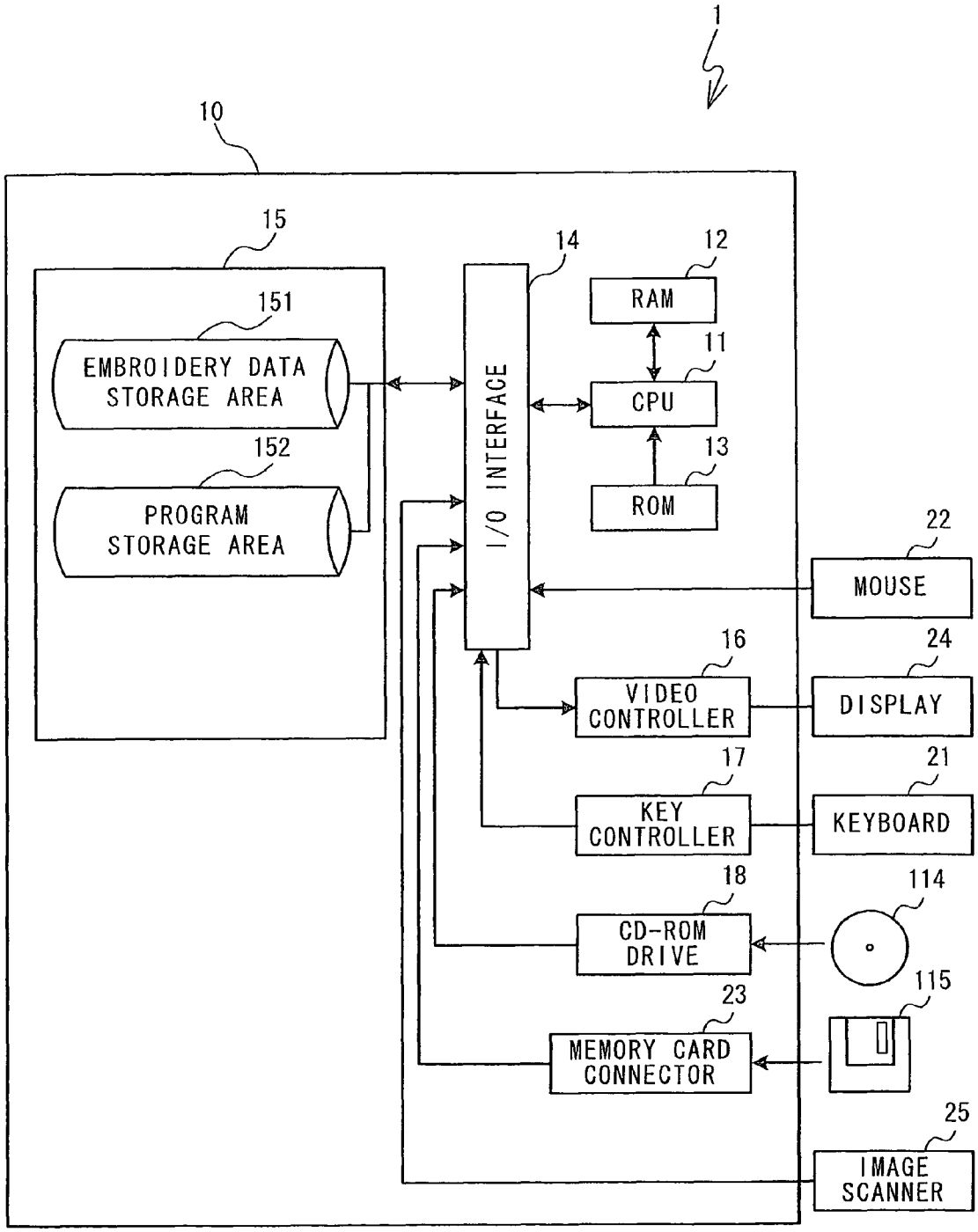
FIG. 2 is a block diagram that shows an electrical configuration of the embroidery data generating device.

First, a configuration of an embroidery data generating device 1 will be explained with reference to FIGS. 1 and 2. The embroidery data generating device 1 is a device that generates data for an embroidery pattern that will be sewn by an embroidery sewing machine 3 that will be described below. In particular, the embroidery data generating device 1 in the present embodiment may generate embroidery data for an embroidery pattern that is formed by arranging a plurality of cross-stitches. As shown in FIG. 1, the embroidery data generating device 1 may be, for example, a general-purpose device such as a personal computer or the like. The embroidery data generating device 1 that is illustrated in FIG. 1 is provided with a main body 10, as well as a keyboard 21, a mouse 22, a display 24, and an image scanner 25 that are connected to the main body 10.

Next, an electrical configuration of the embroidery data generating device 1 will be explained. As shown in FIG. 2, the embroidery data generating device 1 is provided with a CPU 11, which is a controller that performs control of the embroidery data generating device 1. A RAM 12, a ROM 13, and an input/output (I/O) interface 14 are connected to the CPU 11. The RAM 12 temporarily stores various types of data. A BIOS and the like are stored in the ROM 13. The I/O interface 14 mediates exchanges of data. A hard disk drive (HDD) 15, the mouse 22, which is an input device, a video controller 16, a key controller 17, a CD-ROM drive 18, a memory card connector 23, and the image scanner 25 are connected to the I/O interface 14. The embroidery data generating device 1 may also be provided with an external interface for connecting to an external device and a network, which is not shown in FIG. 2.

The HDD 15 has a plurality of storage areas that include an embroidery data storage area 151 and program storage area 152. Embroidery data that are generated by an embroidery data generating program that is executed by the CPU 11 are stored in the embroidery data storage area 151. The embroidery data are data that will be used when the embroidery sewing machine 3 performs embroidering. The embroidery data includes information that indicates a color of an embroidery thread and information that indicates stitches (coordinates of needle drop points and a stitching order). A plurality of programs that include the embroidery data generating program, which may be executed by the CPU 11, are stored in the program storage area 152. In a case where the embroidery data generating device 1 is a dedicated device in which the HDD 15 is not provided, the embroidery data generating program may be stored in the ROM 13.

In addition to the storage areas that are described above, various types of storage areas in which is stored other information that is used by the embroidery data generating device 1 are provided in the HDD 15. For example, a default value for setting a size of a cross-stitch, a correspondence relationship between a divided area number and a vertex that defines a unit line segment that serves as a base for a stitch in the divided area, and the like may be stored in the storage areas. The divided area and the unit line segment will be described below.

The display 24, which displays information, is connected to the video controller 16. The keyboard 21, which is an input device, is connected to the key controller 17. A CD-ROM 114 may be inserted into the CD-ROM drive 18. For example, when the embroidery data generating program is installed, the CD-ROM 114 that stores the embroidery data generating program, which is a control program of the embroidery data generating device 1, may be inserted into the CD-ROM drive 18. The embroidery data generating program may be then set up and may be stored in the program storage area 152 of the HDD 15. A memory card 115 may be connected to the memory card connector 23, and information may be read from the memory card 115 and written to the memory card 115.

Next, the embroidery sewing machine 3 that sews the embroidery pattern based on the embroidery data that are generated by the embroidery data generating device 1 will be briefly explained with reference to FIG. 3.

Figure 3:
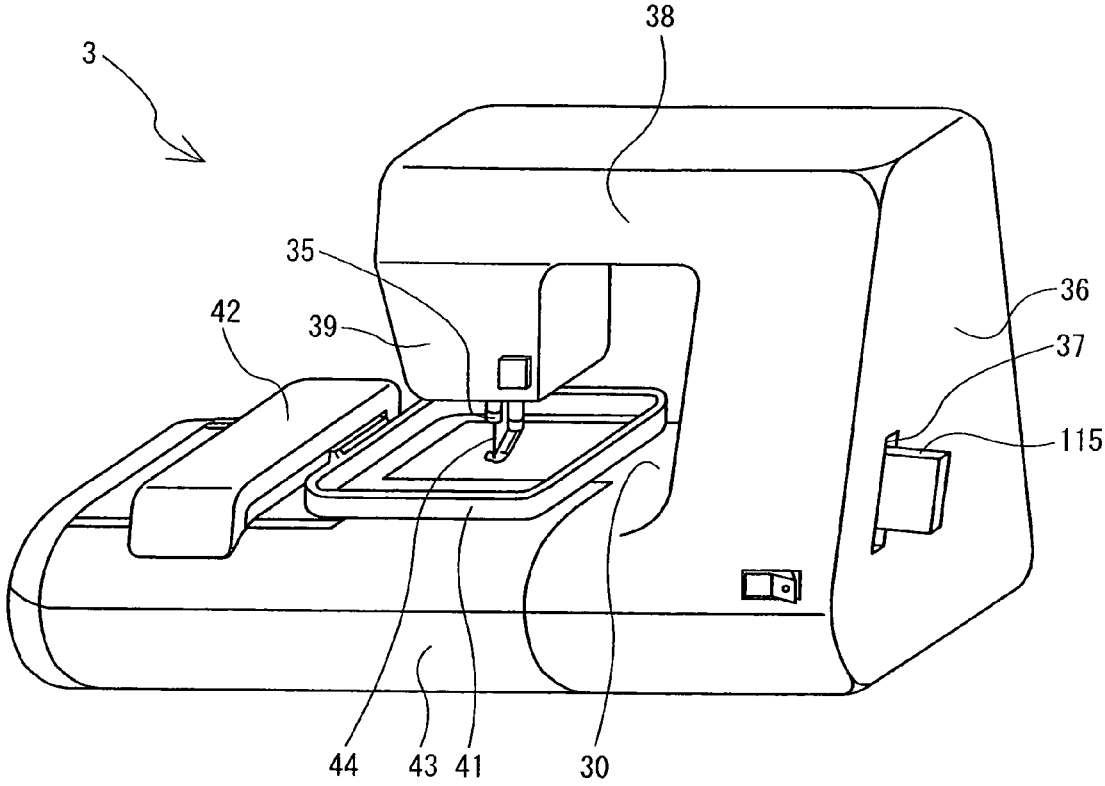
FIG. 3 is an external view of an embroidery sewing machine.

As shown in FIG. 3, the embroidery sewing machine 3 is provided with a bed 30, a pillar 36, an arm 38, and a head 39. The long dimension of the bed 30 runs left to right in relation to a user. The pillar 36 extends upward from the right end of the bed 30. The arm 38 extends to the left from the upper portion of the pillar 36. The head 39 is joined to the left end of the arm 38. An embroidery frame 41, which holds a work cloth on which embroidery will be performed, is disposed on the bed 30. An X direction drive mechanism (not shown in the drawings), which is accommodated within a main body case 43, and a Y direction drive portion 42 move the embroidery frame 41 to a position that is indicated by an XY coordinate system that is specific to the embroidery sewing machine 3. A needle bar 35, on which a stitching needle 44 may be mounted, and a shuttle mechanism (not shown in the drawings) are driven in conjunction with the moving of the embroidery frame 41. In this manner, the embroidery pattern is formed on the work cloth. The X direction drive mechanism, the Y direction drive portion 42, the needle bar 35, and the like are controlled by a control unit (not shown in the drawings) that is configured from a microcomputer or the like that is built into the embroidery sewing machine 3.

A memory card slot 37, which the memory card 115 may be inserted into and be removed from, is provided on a side face of the pillar 36. For example, the embroidery data that are generated by the embroidery data generating device 1 may be stored in the memory card 115 through the memory card connector 23. The memory card 115 is then inserted into the memory card slot 37, the embroidery data that are stored in the memory card 115 are read out, and the embroidery data are stored in the embroidery sewing machine 3. The control unit (not shown in the drawings) of the embroidery sewing machine 3 controls operations of the X direction drive mechanism, the Y direction drive portion 42, a needle bar 35, and the like for sewing the embroidery pattern based on the embroidery data that are supplied from the memory card 115. This makes it possible to use the embroidery sewing machine 3 to sew the embroidery pattern based on the embroidery data that are generated by the embroidery data generating device 1.

Figure 4:
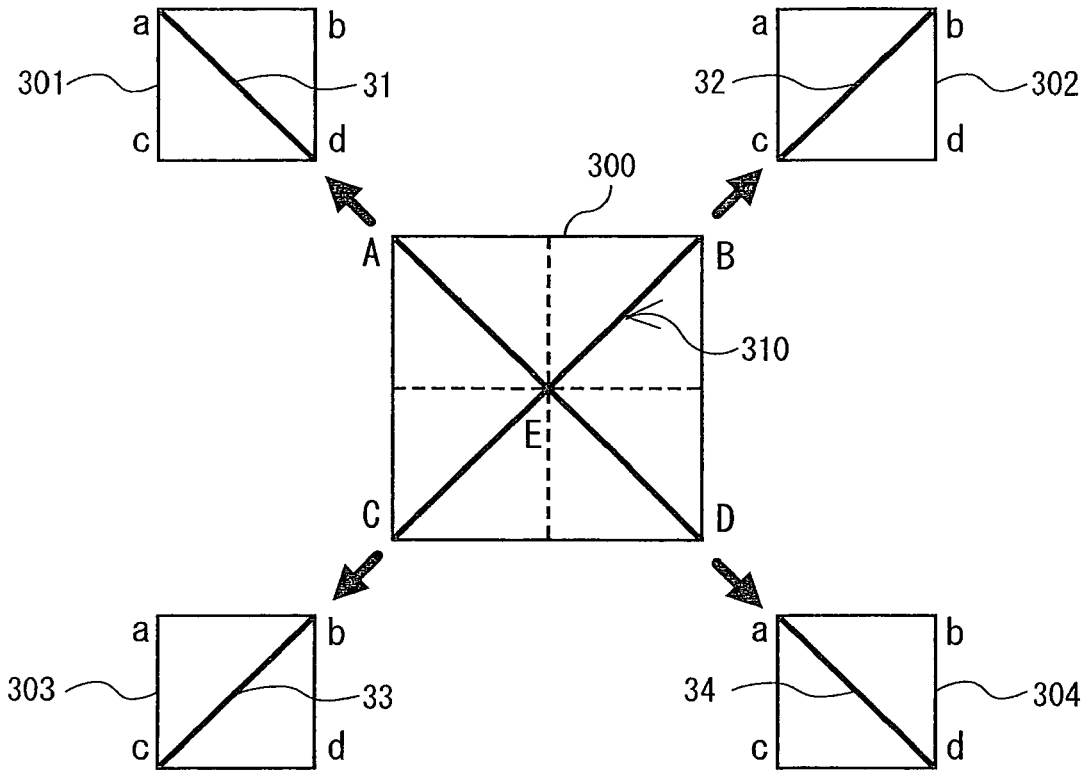
FIG. 4 is an explanatory figure of a cross area and four divided areas into which the cross area is divided.

Next, the cross-stitches that form the embroidery pattern will be explained with reference to FIGS. 4 to 6. As shown in FIG. 4, a whole cross-stitch 310 is formed from stitches that are formed on two line segments AD and BC that intersect one another at their midpoints in an X shape. An area that is occupied by a cross-stitch is a rectangular area 300 that is formed by joining all of the endpoints A, B, C, and D of the two line segments AD and BC. Hereinafter, the rectangular area 300 that is occupied by a cross-stitch is referred to as a cross area 300. An ordinary cross-stitch is formed on two line segments of the same length that intersect with each other at right angles. In this case, the cross area 300 is a square. In the explanation that follows, the cross area 300 will be explained as a square, but a cross-stitch may be formed on two line segments that do not intersect at right angles. In that case, the cross area 300 is a rectangle that is one of vertically long and horizontally long.

Figure 9:
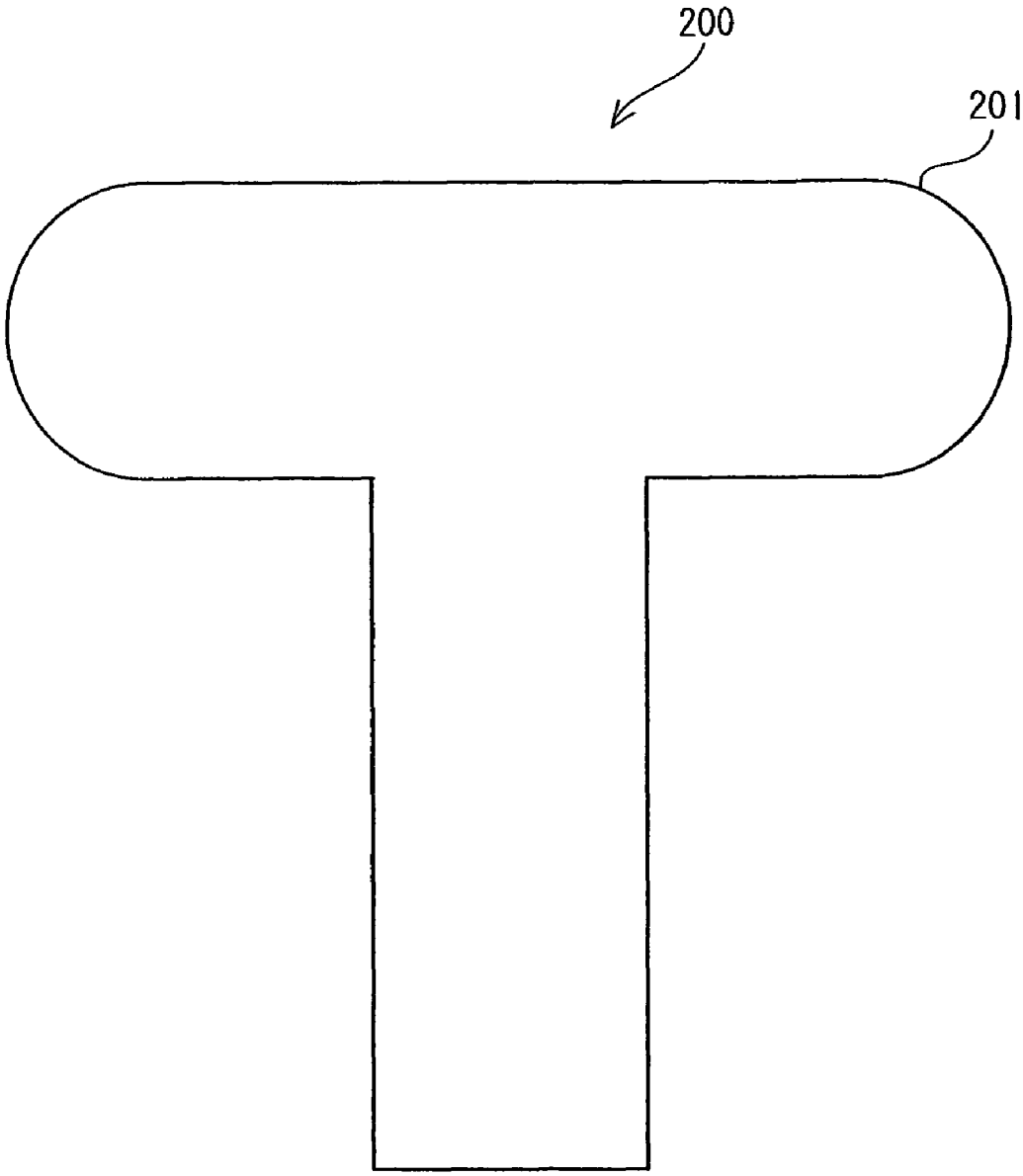
FIG. 9 is an explanatory figure of a closed region that is an original form.

First, a case in which the embroidery pattern is formed by a known embroidery data generating device using cross-stitches will be explained. In a case where an original form is a T-shape that is shown in FIG. 9, the form is expressed by arranging identical whole cross-stitches without any gaps between the cross-stitches, as shown in FIG. 5. In this sort of cross-stitch arrangement, the only two choices are to form and not to form a whole cross-stitch in each of the cross areas 300. Accordingly, a contour line 501 of an entire embroidery pattern 500 may deviate from a contour line 201 of the original form, which is shown by a dotted line, as shown in FIG. 5. Furthermore, this sort of cross-stitch arrangement is equivalent to a mosaic in which each of the cross areas 300 is filled in. The contour line 501 of the entire embroidery pattern 500 therefore becomes jagged.

In the present embodiment, as shown in FIG. 4, the cross area 300 is divided into four rectangles for which an intersection point E of the two line segments AD and BC serves as a vertex. In the four rectangles 301, 302, 303, and 304 that are thus produced respectively include line segments AE, BE, CE, and DE as diagonal lines ad, bc, cb, and da. The lengths of the line segments AE, BE, CE, and DE are each one-half the length of the two line segments AD and BC that serve as the bases for the stitches of the cross-stitch. Here, as shown in FIG. 4, the endpoints of the two line segments AD and BC are points A, B, C, and D. Hereinafter, the rectangular areas 301 to 304 that are produced by dividing the cross area 300 are respectively referred to as divided areas 301 to 304. Further, the line segments ad, bc, cb, and da that are the diagonal lines of the divided areas 301 to 304 are referred to as unit line segments 31 to 34.

In the present embodiment, in order to form the embroidery pattern, a stitch is formed in each of the divided areas 301 to 304 on the unit line segments 31 to 34 that correspond to the divided areas. Therefore, it is not the case that a whole cross-stitch is formed in each of the cross areas 300. In the present embodiment, the stitch that is formed on each of the unit line segments 31 to 34 is referred to as a quarter cross-stitch. A determination is made as to whether a quarter cross-stitch will be formed in each of the divided areas 301 to 304. In addition, as shown in FIG. 6, stitch patterns that are formed in the entire cross area 300 are divided into five groups according to the number of the quarter cross-stitches that are formed. In the groups with one to three quarter cross-stitches, the stitch patterns differ according to which of the divided areas 301 to 304 a quarter cross-stitch is formed in. A total of sixteen different stitch patterns may be formed.

Processing that determines whether a quarter cross-stitch will be formed in each of the divided areas 301 to 304 will be described in detail below. Hereinafter, a whole cross-stitch that is formed in the cross area 300, as well as any combination of one to three quarter cross-stitches (any of the stitch patterns in FIG. 6 in which the number of quarter cross-stitches is one to three), is simply referred to as a cross-stitch.

Embroidery data generation processing that is performed by the embroidery data generating device 1 will be explained below with reference to FIGS. 7 to 26. The embroidery data generation processing that is shown in FIG. 7 is performed by the CPU 11 in accordance with the embroidery data generating program that is stored in the program storage area 152 of the HDD 15.

Figure 7:
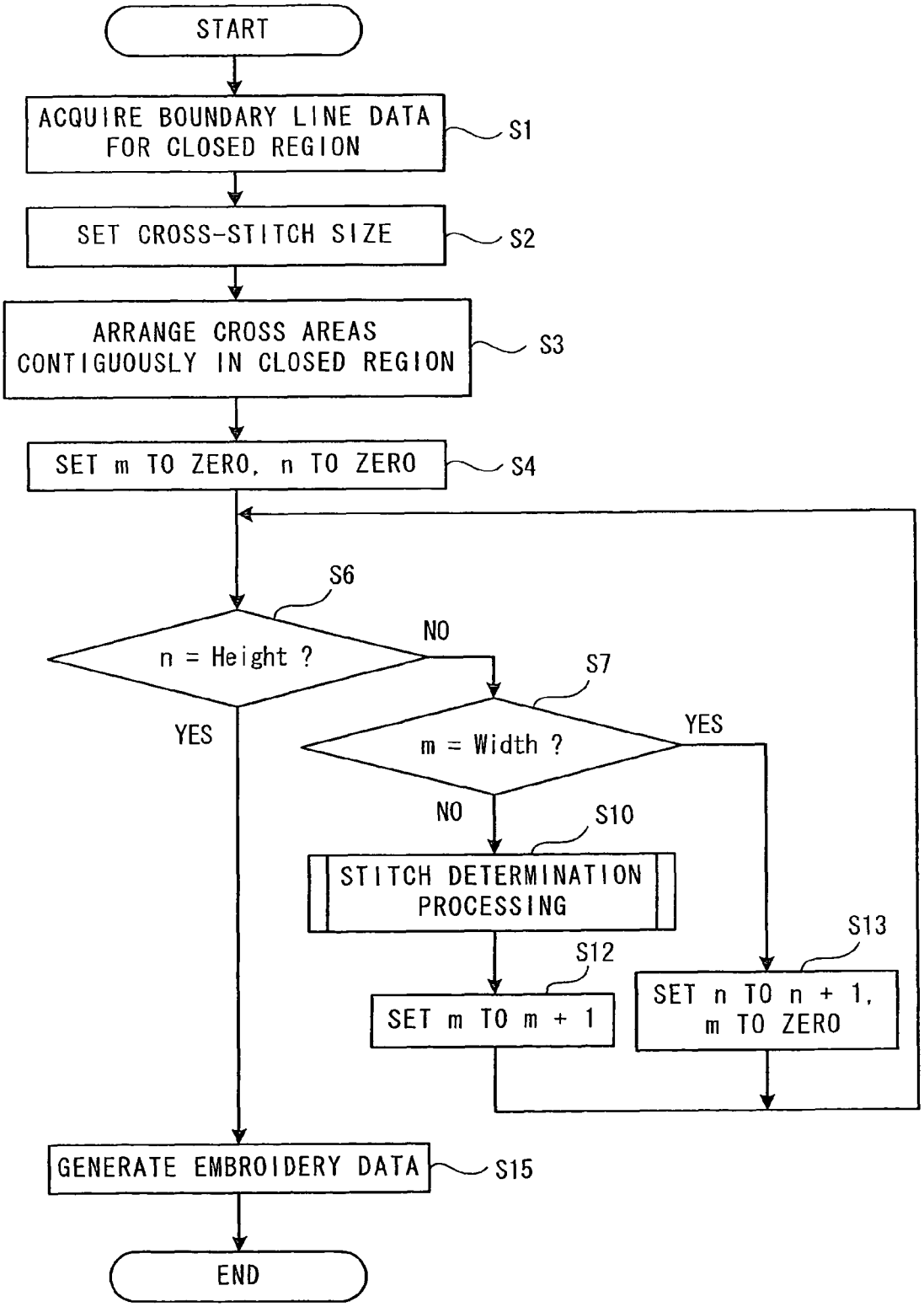
FIG. 7 is a flowchart of main processing in the embroidery data generating device.

As shown in FIG. 7, when main processing is started, first, boundary line data are acquired for a closed region that has a shape, and are stored in a specified storage area of the RAM 12 (Step S1). The closed region for which the boundary line data are acquired is a form that serves as the base for the embroidery pattern that is formed by the cross-stitches. Hereinafter, as an example, a case will be explained in which the original form is a T-shaped closed region 200 that is shown in FIG. 9, with the ends of the horizontal bar of the T being rounded. The boundary line of the closed region 200 corresponds to the contour line 201 of the form. The boundary line data for the closed region 200 (for example, coordinate array data for points on the boundary line) may be acquired by any method. For example, the boundary line data may be acquired by performing known closed region extraction processing on an image that is read by the image scanner 25 and is stored in the RAM 12. For example, Japanese Laid-Open Patent Publication No. 11-123289 discloses a closed region extraction processing method, the relevant portions of which are herein incorporated by reference.

Alternatively, on a command screen that is displayed on the display 24, the user may be prompted to click the mouse 22 at a plurality of freely selectable positions. A group of line segments that sequentially connect positions where a pointer is located when the mouse 22 is clicked may then be treated as a boundary line of a closed region. A closed region may also be formed such that a track of movement by the pointer of the mouse 22 serves as the boundary line. In this case, if the track of the pointer movement is not closed, a closed region may be formed by connecting a starting point and an ending point of the movement track. Boundary line data for a closed region may also be input to the embroidery data generating device 1 from one of the memory card 115 and an external device through one of the memory card connector 23 and the external interface (not shown in the drawings).

Once the boundary line data have been acquired (Step S1), a size of the cross-stitches that will form the embroidery pattern is set (Step S2). The length of a stitch that configures a whole cross-stitch, that is, the length of a diagonal line of the cross area 300, may also be set as the size of the cross-stitches. The length of one side of the cross area 300 may also be set as the size of the cross-stitches. The size of the cross-stitches may also be designated by the user. A predetermined size that is stored in a specified storage area of the HDD 15 may also be used. In a case where a predetermined size is used, a plurality of different sizes may be prepared, and one of the sizes may be selected in accordance with the size of the closed region that is the original form.

In the present embodiment, a setting screen that includes a size input space is displayed on the display 24 at Step S2. When a given size is input by the user, the size that has been input is set as the length of one side of the cross area 300. In a case where the setting screen is closed without the user's having made any input, a default value (for example, 2.5 mm) is set as the length of one side of the cross area 300. Information about the size that has been set is stored in a specified storage area of the RAM 12.

Figure 10:
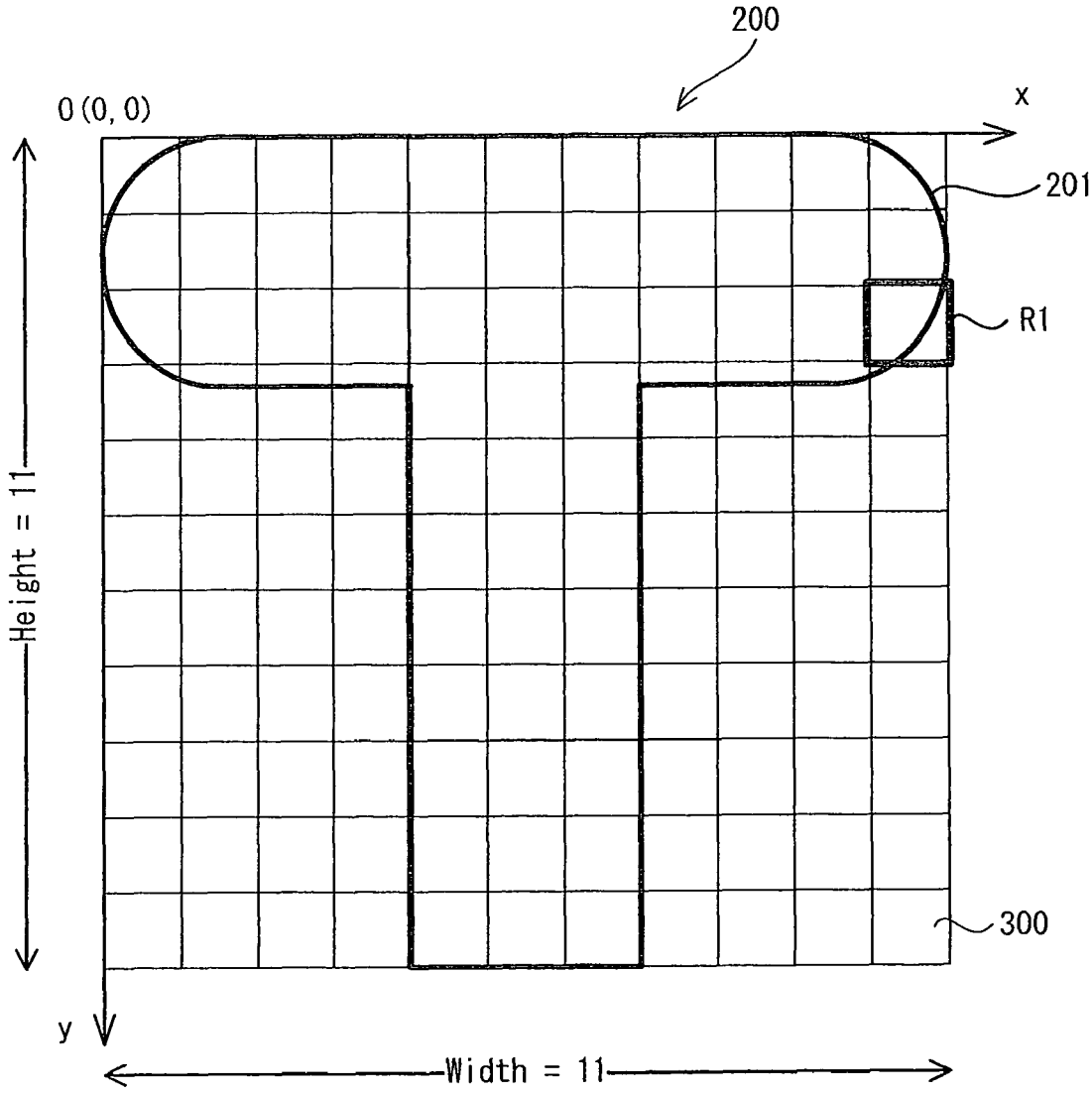
FIG. 10 is an explanatory figure of cross areas that are arranged contiguously in a coordinate system in which a closed region is shown.

Once the size of the cross-stitches has been set (Step S2), the size of the cross area 300, that is the size of one side of the square, is determined based on the size that has been set. In the present embodiment, the size that is set at Step S2 is used as is for the size of the cross area 300. Next, the cross areas 300 are arranged contiguously in a coordinate system in which the closed region for which the boundary line data were acquired at Step S1 is shown (Step S3). In the present embodiment, as shown in FIG. 10, an x axis in the horizontal direction and a y axis in the vertical direction are provided in a coordinate system in which the T-shaped closed region 200 is shown. On the x axis, the rightward direction is the positive direction. On the y axis, the downward direction is the positive direction. One vertex of one of the square cross areas 300 is located at an origin point O (0, 0), and the cross areas 300 are arranged contiguously, without any gaps between the cross areas 300. Next, a cross area coordinate table 51 (refer to FIG. 11) and a cross area layout table 52 (refer to FIG. 12) are created and are stored in a specified storage area of the RAM 12. The cross area coordinate table 51 shows the coordinates of the vertices of each of the cross areas 300. The cross area layout table 52 shows the layout of each of the cross areas 300.

As shown in FIG. 11, the cross area coordinate table 51 includes four items, for example, cross area numbers, vertices, x coordinates, and y coordinates, which are stored in association with one another. The cross area number is an identification number for the cross area 300. The vertices are codes that identify the four vertices of each of the cross areas 300. In the present embodiment, of the four vertices of the cross area 300, the vertex for which the values of the x coordinate and the y coordinate are the lowest (the upper left vertex in the drawings) is defined as a vertex A. A vertex that has the same y coordinate as the vertex A is defined as a vertex B, and a vertex that has the same x coordinate as the vertex A is defined as a vertex C. The remaining vertex is defined as a vertex D. The x coordinates and the y coordinates are values that indicate the x coordinates and the y coordinates of each of the vertices A to D.

The cross area numbers are unique numbers that are individually assigned to all of the cross areas 300 (in the example in FIG. 10, 11×11=121) that are arranged in the coordinate system in which the closed region is shown. Therefore, coordinate data items the number of which corresponds to the number of the cross areas 300 that are arranged in the coordinate system are included in the cross area coordinate table 51, although most of the data items are not shown in FIG. 11.

As shown in FIG. 12, the cross area layout table 52 is a table in which, for example, a column item is defined as m and a row item is defined as n. The number of the column items m that are provided is equal to the number of the cross areas 300 that were arranged in the x axis direction at Step S3 (11 in the example in FIG. 10), although not all of them are shown in FIG. 12. The number of the row items n that are provided is equal to the number of the cross areas 300 that were arranged in the y axis direction at Step S3 (11 in the example in FIG. 10). In a cell that is indicated by m and n, the cross area number of the cross area 300 in that position in the coordinate system is stored.

Next, a value m of an x direction counter and a value n of a y direction counter for processing in order the cross areas 300 that are arranged contiguously as described above are both set to an initial value of zero (0) (Step S4). In the present embodiment, the cross areas 300 that have the cross area numbers that are stored in positions in the cross area layout table 52 that correspond to the counter value m and the counter value n are processed in order.

First, a determination is made as to whether the value n of the y direction counter is equal to Height, which is a value that indicates the number of the cross areas 300 that are arranged in the y axis direction (Step S6). In the example in FIG. 10, Height is 11. The first time the processing is performed, the counter value n is zero, so is not equal to Height (NO at Step S6). In other words, in the y axis direction, there is an unprocessed cross area 300 remaining. Accordingly, a determination is made as to whether the value m of the x direction counter is equal to Width, which is a value that indicates the number of the cross areas 300 that are arranged in the x axis direction (Step S7). In the example in FIG. 10, Width is 11. The first time the processing is performed, the counter value m is zero, so is not equal to Width (NO at Step S7). In other words, in the x axis direction, there is an unprocessed cross area 300 remaining. Accordingly, for each of the divided areas 301 to 304 that are included in the cross area 300 that is the target of the processing, stitch determination processing is performed that determines whether a quarter cross-stitch will be formed (Step S10).

The stitch determination processing will be explained in detail with reference to FIG. 8. First, the coordinate data for the cross area 300 that is the target of the processing are read out from the cross area coordinate table 51 (Step S100). The first time that the processing is performed, the counter values m and n are both zero. Therefore, the cross area layout table 52 is referenced, and the cross area 300 for which the cross area number is zero is specified as the target of the processing. Accordingly, the coordinate data for the vertices A to D that correspond to the cross area number zero are read out from the cross area coordinate table 51.

Next, the cross area 300 is divided into four parts that are defined as the divided areas 301 to 304 (Step S101). Specifically, the coordinates of the four vertices a to d of each of the divided areas 301 to 304 are determined based on the coordinates of the vertices A to D that have been read out for the cross area 300. Then a divided area table 53 (refer to FIG. 13) is generated and is stored in a specified storage area of the RAM 12.

As shown in FIG. 13, the divided area table 53 includes six items, for example, cross area numbers, divided area numbers, vertices, x coordinates, y coordinates, and stitch flags, which are stored in association with one another. An identification number for the cross area 300 that is the target of the processing is stored as the cross area number. The divided area numbers are identification numbers that are respectively assigned to the divided areas 301 to 304. In the present embodiment, the identification numbers 0, 1, 2, and 3 are respectively assigned to the divided areas 301, 302, 303, and 304.

The vertices are codes that identify the four vertices of each of the divided areas 301 to 304. In the present embodiment, as shown in FIG. 4, of the four vertices of each of the divided areas 301 to 304, the vertex for which the values of the x coordinate and the y coordinate are the lowest (the upper left vertex in FIG. 4) is defined as the vertex a. Of the four vertices of each of the divided areas 301 to 304, the vertex that has the same y coordinate as the vertex a (the upper right vertex in FIG. 4) is defined as the vertex b, and a vertex that has the same x coordinate as the vertex a (the lower left vertex in FIG. 4) is defined as the vertex c. The remaining vertex (the lower right vertex in FIG. 4) is defined as the vertex d. The x coordinates and the y coordinates are values that indicate the x coordinates and the y coordinates of each of the vertices a to d.

The stitch flag is information that indicates, by ON and OFF, whether a quarter cross-stitch will be formed in each of the divided areas 301 to 304. The initial value for the flag that is stored when the divided area table 53 is generated is OFF. In the present embodiment, the cross areas 300 are processed one at a time. Therefore, when each of the cross areas 300 is processed, the data for the four divided areas 301 to 304 that correspond to each of the cross areas 300 are added to the divided area table 53.

Once the cross area 300 that is the target of the processing has been divided into the four divided areas 301 to 304 and the divided area table 53 has been generated (Step S101), a value i of a divided area counter for processing the generated divided areas 301 to 304 in order is set to zero (0) (Step S102). Next, a determination is made as to whether the counter value i is equal to four, which is the total number of the divided areas 301 to 304 that are being processed (Step S103). The first time that the processing is performed, the counter value i is zero, so is not equal to four (NO at Step S103). In other words, there is an divided area that has not yet been processed. Accordingly, the coordinate data for the divided area that is the target of the processing are acquired from the divided area table 53. Then a closed region coverage rate is computed that is a percentage of the divided area that is covered by the closed region. In the present embodiment, surface area is used in the computing of the closed region coverage rate.

First, the surface area within the divided area that is covered by the closed region is computed (Step S104). The surface area within the divided area that is covered by the closed region may be determined by the method that is explained below, for example. As described previously, the coordinates of the four vertices a to d of the divided areas are stored in the divided area table 53. In addition, the boundary line data for the closed region has been acquired at Step S1 of the main processing (refer to FIG. 7) and stored in the RAM 12. Therefore, based on the coordinates of the vertices a to d and on the boundary line data for the closed region, it is possible to determine a point of intersection between a boundary line of the divided area and the boundary line of the closed region and to determine the coordinates of the boundary line of the closed region that lie within the divided area. In a case where the portion of the closed region within the divided area is described as a polygon, a surface area S of the polygon may be determined as described below.

First, an origin point is defined within the plane of the polygon (an "n-agon"). Once this is done, the polygon is divided into a number n of triangles for which the origin point within the plane serves as a vertex. In general, in a case where an orthogonal coordinate system is introduced in which one of the vertices of a triangle serves as the origin point and another two points are expressed as $(x_1, y_1)$ and $(x_2, y_2)$, a surface area s of the triangle may be determined by the equation below.

$$s = \frac{1}{2}(x_1 y_2 - x_2 y_1) \quad \text{Equation 1}$$

Therefore, the surface area S of the polygon may be determined by computing the sum of the surface areas of the number n of triangles into which the polygon has been divided, as shown in by the equation below.

$$S = \left|\sum_{i=1}^{n} s_i\right| = |s_1 + s_2 + s_3 + \ldots + s_n| \quad \text{Equation 2}$$

A case where the boundary line of the closed region within the divided area includes a curve may be handled by dividing the polygon into smaller triangles. The surface area within the divided area that is covered by the closed region may be determined using a method other than that described above, such as Green's theorem for a plane, for example.

Once the surface area within the divided area that is covered by the closed region has been computed (Step S104), the closed region coverage rate is computed (Step S105). The surface areas of the divided areas may be computed by dividing by four the surface area of the cross area 300, which is computed based on the length of one side of the cross area 300, which was set at Step S2 in the main processing, and dividing the surface area. Accordingly, the closed region coverage rate is computed by dividing the surface area within the divided area that is covered by the closed region by the surface area of the divided area.

Figure 8:
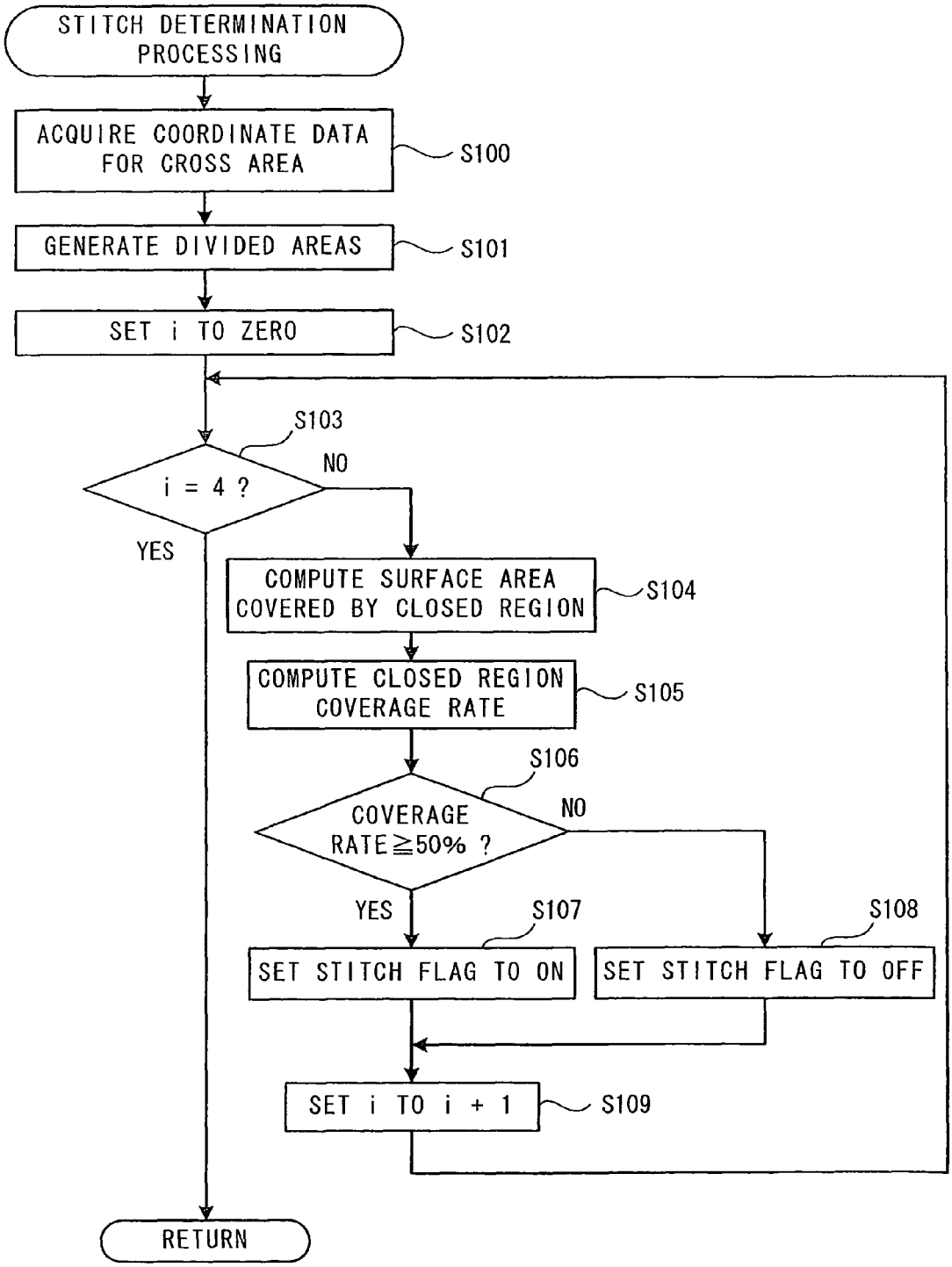
FIG. 8 is a flowchart of stitch determination processing that is performed in the main processing.

In the stitch determination processing that is shown in FIG. 8, after the closed region coverage rate within the divided area that is the target of the processing is computed (Step S105), a determination is made as to whether the closed region coverage rate is greater than or equal to 50% (Step S106). If the closed region coverage rate is greater than or equal to 50% (YES at Step S106), the stitch flag for the divided area that is the target of the processing is changed from the initial value of OFF to ON in the divided area table 53 (Step S107). In other words, it is determined that a quarter cross-stitch will be formed that corresponds to a unit line segment in the divided area that is the target of the processing. Then, after 1 is added to the value i of the divided area counter (Step S109), the processing returns to Step S103.

As shown in FIG. 4, the unit line segments 31 to 34 in the divided areas 301 to 304 are diagonal lines in specified directions. Specifically, the unit line segments 31 and 34 in the divided areas 301 and 304 are diagonal lines that connect the upper left vertex a and the lower right vertex d. In contrast, the unit line segments 32 and 33 in the divided areas 302 and 303 are diagonal lines that connect the upper right vertex b and the lower left vertex c. Accordingly, in a case where correspondence relationships between the divided area numbers 0 to 3 and the vertices that define the unit line segments in the divided areas are stored in advance in a specified storage area of the HDD 15, it is possible to specify which vertices are connected in the divided area in a case where a quarter cross-stitch is formed.

On the other hand, if the closed region coverage rate within the divided area that is the target of the processing is neither greater than nor equal to 50% (NO at Step S106), the stitch flag for the divided area that is the target of the processing is left at the initial value of OFF (Step S108), and the processing advances to Step S109. In other words, if the closed region coverage rate is neither greater than nor equal to 50%, it is determined that a quarter cross-stitch that corresponds to a unit line segment in the divided area that is the target of the processing will not be formed. Then, after 1 is added to the value i of the divided area counter (Step S109), the processing returns to Step S103.

The second time that the stitch determination processing is performed, the value of the divided area counter is 1 (NO at Step S103). Therefore, the divided area 302 that corresponds to the counter value i (1) is made the target of the processing, coordinate data for the divided area 302 are read out, and the surface area within the divided area 302 that is covered by the closed region is computed (Step S104). Then the closed region coverage rate is computed (Step S105). Next, in accordance with the computed closed region coverage rate, a determination is made as to whether or not to form a quarter cross-stitch in the divided area 302 (one of Step S107 and Step S108). In the same manner, the third and fourth times that the stitch determination processing is performed, determinations are made as to whether quarter cross-stitches will be formed in the divided areas 303 and 304. After the processing has been completed for the fourth time, for the divided area 304, 1 is added to the counter value i, such that i becomes 4 (Step S109). It is then determined that the counter value i is equal to 4 (YES at Step S103), and the stitch determination processing that is shown in FIG. 8 is terminated.

In the main processing that is shown in FIG. 7, once the stitch determination processing that is described above has been terminated (Step S10), 1 is added to the value m of the x direction counter, such that the counter value m becomes 1 (Step S12). The processing then returns to Step S6, from which point the processing is performed a second time. The determination is made as to whether the value n of the y direction counter is equal to Height. At this point, because the counter value n is zero, it is determined that there is still an unprocessed cross area 300 in the y axis direction (NO at Step S6). The determination is also made as to whether the counter value m is equal to Width (Step S7). Because the counter value m is 1, it is determined that there is still an unprocessed cross area 300 in the x axis direction (NO at Step S7).

Accordingly, the cross area layout table 52 is referenced, and the cross area number is specified that is stored in association with the value m (1) of the x direction counter and the value n (0) of the y direction counter. The stitch determination processing is then performed that determines whether a quarter cross-stitch will be formed for each of the divided areas 301 to 304 that are included in the cross area 300 that has the cross area number 1 (Step S10). Because the counter value m (1) is not equal to Width, the counter value m is increased to 2 (Step S12). The processing is repeated in the same manner for the third and subsequent times.

The eleventh time that the processing is performed, once the stitch determination processing has been completed for the cross area 300 that is positioned at the right end in the x axis direction (Step S10), 1 is added to the value m of the x direction counter, such that the counter value m becomes 11. Once that has been done, the value n of the y direction counter is still zero, so it has not reached the value of Height (11) (NO at Step S6). The counter value m is 11, so is determined that the counter value m is equal to Width (YES at Step S7). In this case, that means that the processing has been completed for one row's worth of the cross areas 300 that are arranged in the x axis direction. Therefore, in order to shift to the processing of the next row of the cross areas 300, 1 is added to the counter value n, such that the counter value n becomes 1, and the counter value m is reset to the initial value of zero (Step S13).

In the same manner, the processing of the cross areas 300 is performed in order, moving to the right (the positive direction) along the x axis, and when the processing of the entire row has been completed, a shift is made to the next row in the downward direction (the positive direction) along the y axis, and the processing is repeated. Then, when the processing has been completed for the eleventh row, the value n of the y direction counter is set to 11 at Step S13. Accordingly, at Step S6, it is determined that the counter value n is 11 (YES at Step S6). In this case, for each of the divided areas 301 to 304 in each of the cross areas 300 that are arranged in the coordinate system for the closed region, the determination has been made as to whether the quarter cross-stitch will be formed, so the arrangement of the cross-stitches that will form the embroidery pattern has been determined.

Figure 14:
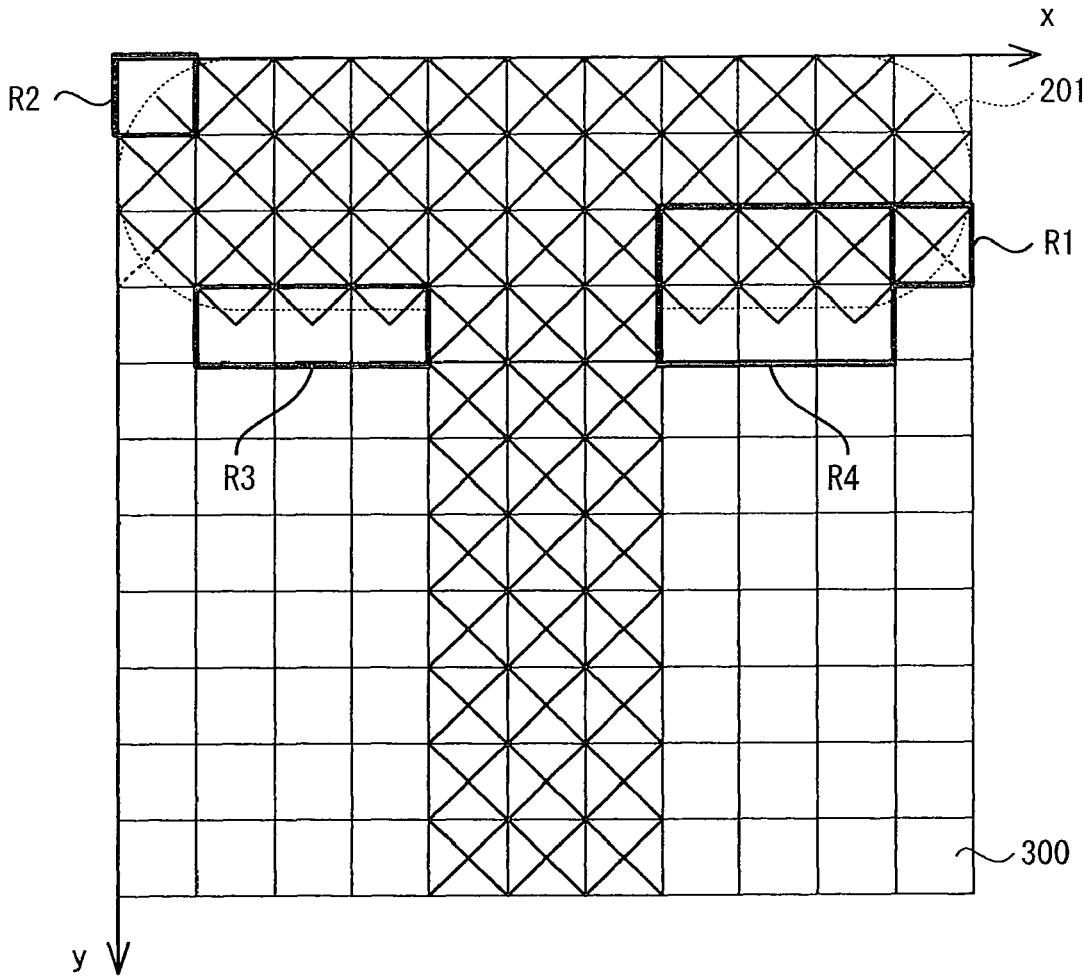
FIG. 14 is an explanatory figure of a cross-stitch arrangement that is determined by a technique of the embodiment of the present disclosure.

For example, in a case where the processing that is described above has been performed with the closed region 200 in FIG. 9 as the original form, the arrangement of the cross-stitches has been determined for the cross areas 300, as shown in FIG. 14. When the arrangement of the cross-stitches that is shown in FIG. 14 is compared to the arrangement of the cross-stitches according to the known method that is shown in FIG. 5, it is obvious that there are differences between the two in regions R1, R2, and R3 that are close to the boundary line (the contour line 201) of the closed region 200.

Figure 15:
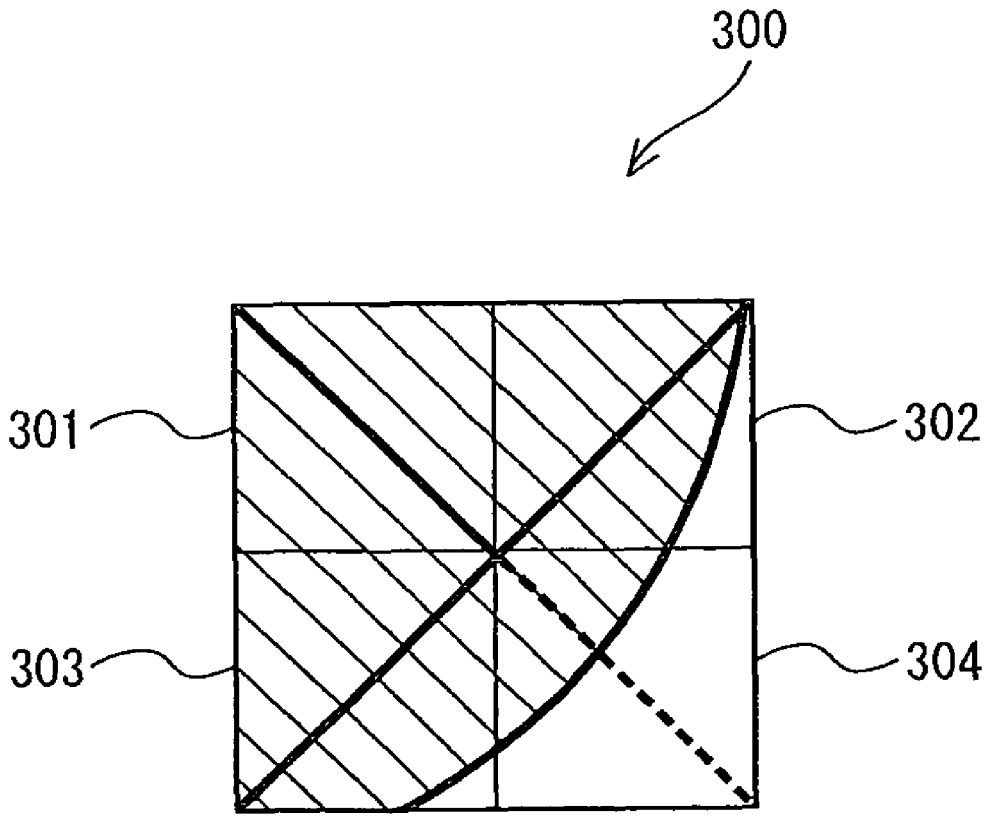
FIG. 15 is an explanatory figure of a stitch that is disposed in a cross area that corresponds to a region R1 in FIG. 14.

According to the known method, the only two choices are to form and not to form a whole cross-stitch in a cross area 300. This means that in the region R1, the entire region is covered by a cross-stitch, even though a portion of the region is not covered by the closed region. In contrast, according to the stitch determination processing in the present embodiment, as shown in FIG. 15, the closed region coverage rates for the divided areas 301, 302, and 303 in the cross area 300 that is included in region R1 are greater than or equal to 50% (YES at Step S106), so the stitch flags for the divided areas 301, 302, and 303 are set to ON (Step S107). However, in the stitch determination processing, the closed region coverage rate for the divided area 304 is neither greater than nor equal to 50% (NO at Step S106), so the stitch flag for the divided area 304 is set to OFF (Step S108). As a result, three quarter cross-stitches are formed in the portions that overlap the closed region in the region R1.

Figure 5:
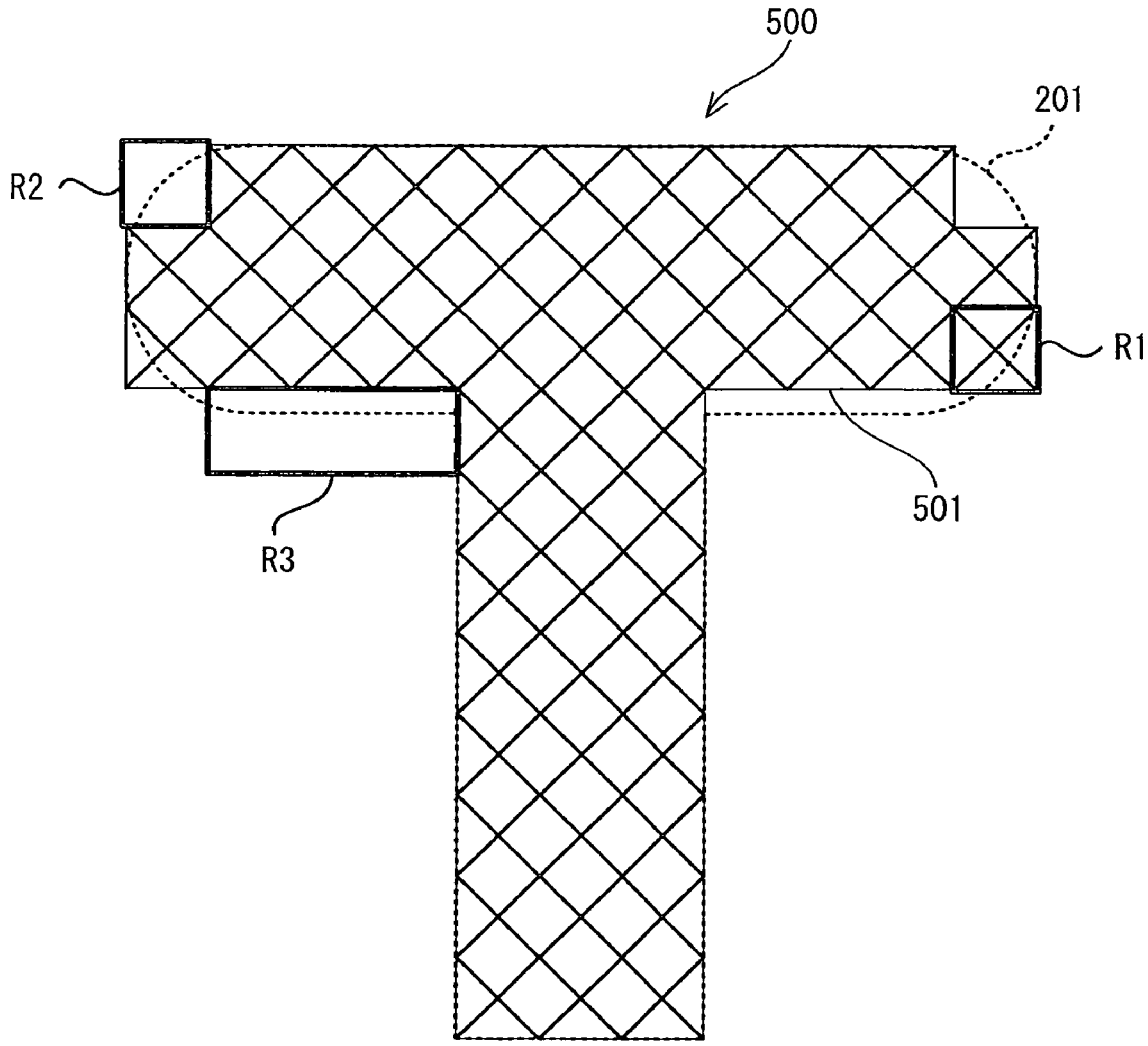
FIG. 5 is an explanatory figure of an embroidery pattern that is formed by a known cross-stitch technique.

Furthermore, according to the known method, as shown in FIG. 5, no cross-stitches are formed in the regions R2 and R3, even though a portion of the closed region that is surrounded by the contour line 201 exists in each of the two regions. In contrast, according to the method in the present embodiment, a quarter cross-stitch is formed in the portion of the region R2 that overlaps the closed region, as shown in FIG. 14. Moreover, in each of the cross areas 300 in the region R3, two quarter cross-stitches are formed in the portion of the cross area 300 that overlaps the closed region.

Thus, even in a case where the boundary line of the cross area 300 separates from the boundary line (the contour line 201) of the closed region (as in the region R3), the method in the present embodiment makes it possible to faithfully express the outline (the contour line 201) of the original form in the cross-stitches. This is also true in a case where the direction in which the boundary line of the cross area 300 extends is different from the direction in which the contour line 201 extends (as in the regions R1 and R2).

In the main processing that is shown in FIG. 7, after the arrangement of the cross-stitches that will form the embroidery pattern has been determined, the embroidery data for sewing the embroidery pattern by the embroidery sewing machine 3 are generated (Step S15), and the main processing is terminated.

Hereinafter, the embroidery data generating processing that is performed at Step S15 will be explained using examples, with reference to FIGS. 16 to 26. As described above, the embroidery data include information that indicates a color of the embroidery thread and information that indicates coordinates of needle drop points and a stitching order for forming stitches of an embroidery pattern. More specifically, for each of colors of embroidery threads, the embroidery data indicate the needle drop points and the stitching order for the stitches that will be formed by the thread of that color. Hereinafter, in order to simplify the explanation, generating of stitch data that indicate needle drop points and a stitching order will be explained using, as an example, an embroidery pattern that is formed by an embroidery thread of one color.

As described above, in the stitch determination processing (refer to FIG. 8), for each of the divided areas 301 to 304 in each of the cross areas 300, the coordinates of the vertices are determined, and a determination is made as to whether a quarter cross-stitch will be formed. Then, as also described above, in a case where a quarter cross-stitch will be formed in any one of the divided areas 301 to 304, information that indicates on which of the unit line segments that connect which of the vertices of the divided areas 301 to 304 a stitch will be formed is stored in the HDD 15 in advance. Therefore, the needle drop points and the stitching order are determined based on this information.

Figure 16:
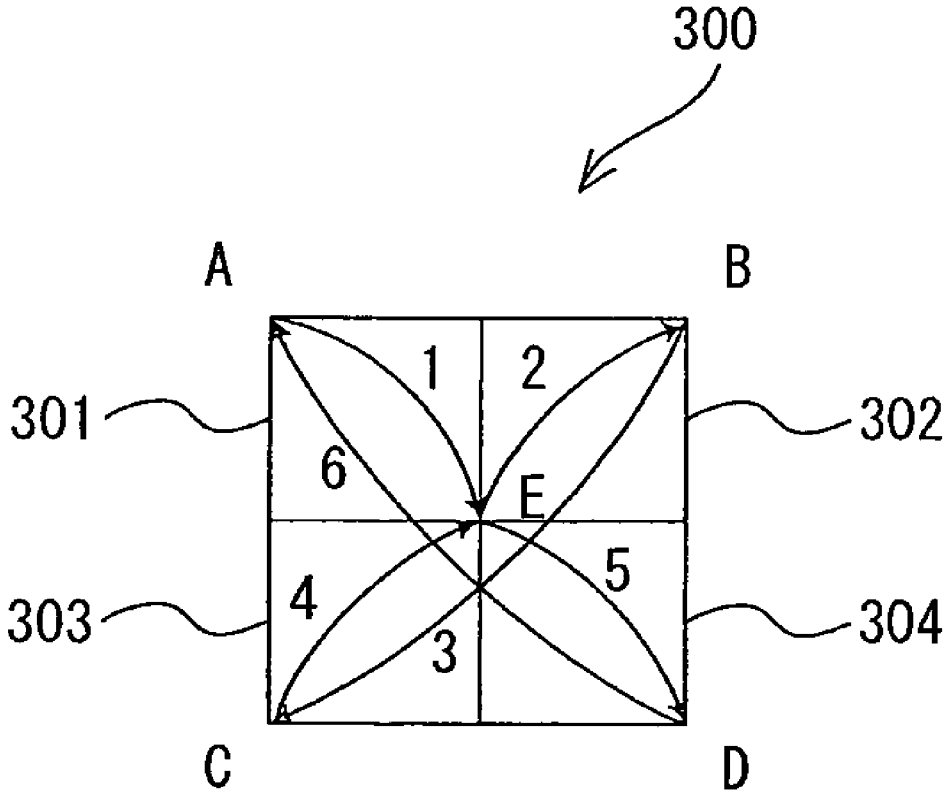
FIG. 16 is an explanatory figure of needle drop points and a stitching order in a case where four stitches are formed in a cross area.

First, the needle drop points and the stitching orders of representative stitch patterns for the cross-stitch that is formed in the cross area 300 in the present embodiment will be explained with reference to FIGS. 16 to 19. Basically, the needle drop points and the stitching order of the stitches in the cross-stitch are determined such that two stitches will be sewn on the same line segment and the position where the stitching starts and the position where the stitching ends will be the same. For example, in a case where it has been determined that the quarter cross-stitches will be formed in all of the divided areas 301 to 304 in the cross area 300, such that a whole cross-stitch will be formed, the basic needle drop points and the basic stitching order are determined as shown in FIG. 16. The numbers that are used in the explanation that follows indicate the stitching order.

Basically, in a case where the upper left vertex A of the cross area 300 (the vertex where the values of the x coordinate and the y coordinate are the smallest) is the stitching starting point and the stitching ending point, the first needle drop point is the vertex A, which is the stitching starting point. The next needle drop point is the point E in the center of the cross area 300, and the first stitch is formed on the unit line segment AE in the divided area 301. The next needle drop point is the upper right vertex B, and the next stitch is sewn on the unit line segment EB in the divided area 302. The next needle drop point is lower left vertex C, and the next stitch is sewn on both the unit line segment BE in the divided area 302 and the unit line segment EC in the divided area 303, such that a stitch is sewn on the line segment BC, which is one of the diagonal lines of the cross area 300.

The next needle drop point is the center point E, and the next stitch is sewn on the unit line segment CE in the divided area 303. The next needle drop point is the lower right vertex D, and the next stitch is sewn on the unit line segment ED in the divided area 304. The final needle drop point, that is, the stitching ending point, is the same upper left vertex A as the stitching starting point, and the next stitch is sewn on both the unit line segment DE in the divided area 304 and the unit line segment EA in the divided area 301, such that a stitch is sewn on the line segment DA, which is one of the diagonal lines of the cross area 300.

Figure 17:
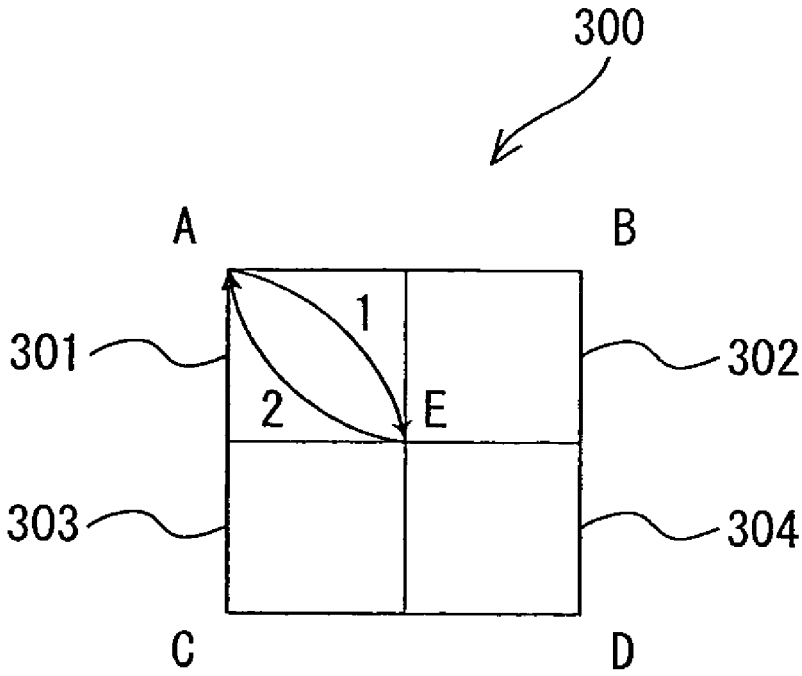
FIG. 17 is an explanatory figure of needle drop points and a stitching order in a case where one stitch is formed in a cross area.
Figure 18:
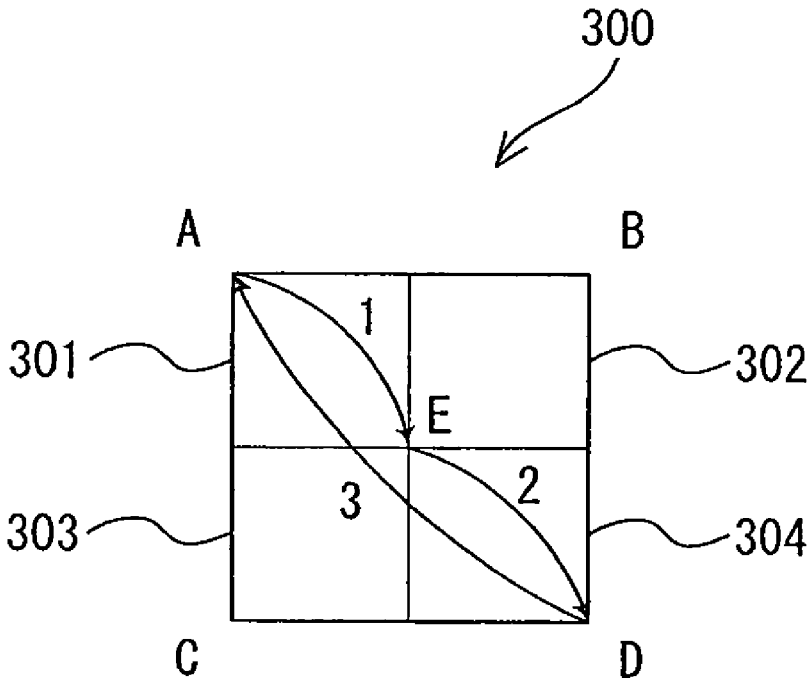
FIG. 18 is an explanatory figure of needle drop points and a stitching order in a case where two stitches are formed in a cross area.
Figure 19:
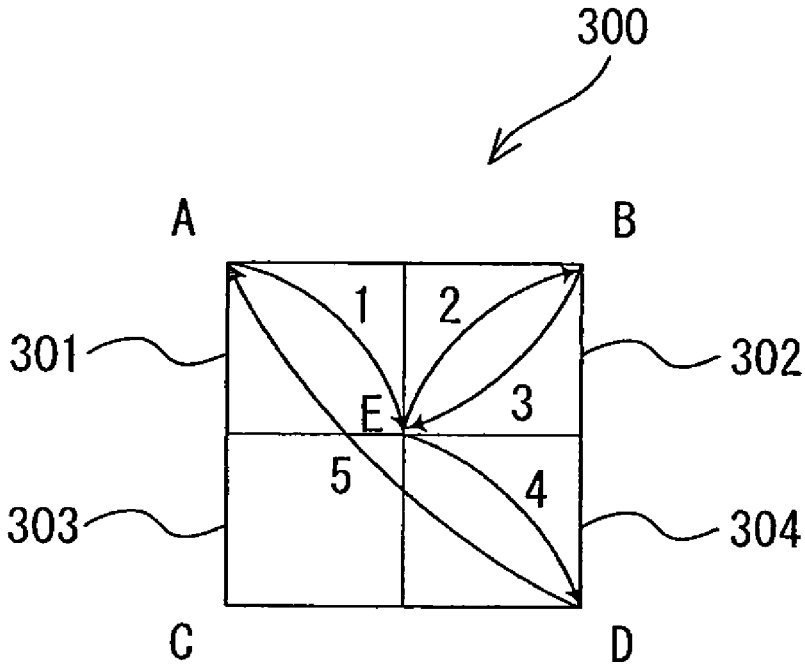
FIG. 19 is an explanatory figure of needle drop points and a stitching order in a case where three stitches are formed in a cross area.
Figure 20:
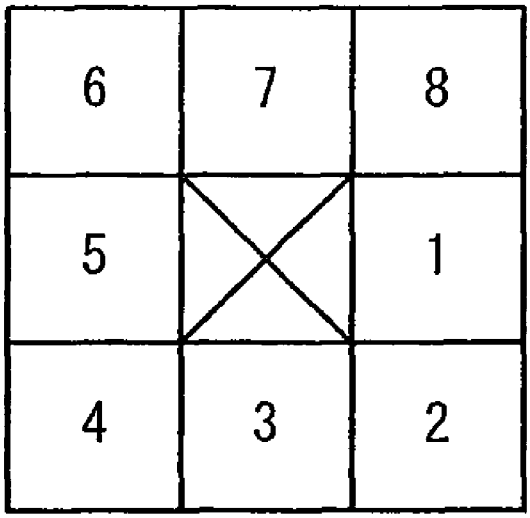
FIG. 20 is an explanatory figure that shows a searching order in a case where search is performed for points where continuous cross-stitches are in contact.

In the same manner, in a case where it has been determined that a quarter cross-stitch will be formed in only one of the divided areas 301 to 304 in the cross area 300, the needle drop points and the stitching order may be determined as shown in FIG. 17, for example. In a case where it has been determined that the quarter cross-stitches will be formed in two of the divided areas 301 to 304 in the cross area 300, the needle drop points and the stitching order may be determined as shown in FIG. 18, for example. In a case where it has been determined that the quarter cross-stitches will be formed in three of the divided areas 301 to 304 in the cross area 300, the needle drop points and the stitching order may be determined as shown in FIG. 19, for example.

Next, the way in which the needle drop points and the stitching order are determined for successive cross-stitches will be explained with reference to FIGS. 14 and 20 to 26. As shown in FIG. 14, the cross areas 300 are arranged in relation to the closed region without any gaps between the cross areas 300. Therefore, the stitches of the cross-stitches that form the embroidery pattern are formed continuously between adjacent cross areas 300. In this sort of case, the needle drop points and the stitching order may be determined as described below, for example.

First, the cross area 300 that is the farthest to the upper left among the cross areas 300 that include divided areas in which it has been determined that the quarter cross-stitches will be formed is defined as the stitching start cross area 300. In the stitching start cross area 300, the upper left vertex A is defined as the stitching starting point and the first needle drop point. Then a tree structure is generated that describes the stitching order between successive cross areas 300. In the generating of the tree structure, a target cross area 300 is defined as the center, and a search is performed for a point of connection with the adjacent cross areas 300 that surround the target cross area 300. The order in which the search is performed is clockwise from the adjacent cross area 300 on the right, as shown by the numbers in FIG. 20. Points of connection with the adjacent cross areas 300 are prioritized in order by the upper left vertex, the upper right vertex, the lower left vertex, and the lower right vertex of the cross area 300 in the center.

Figure 21:
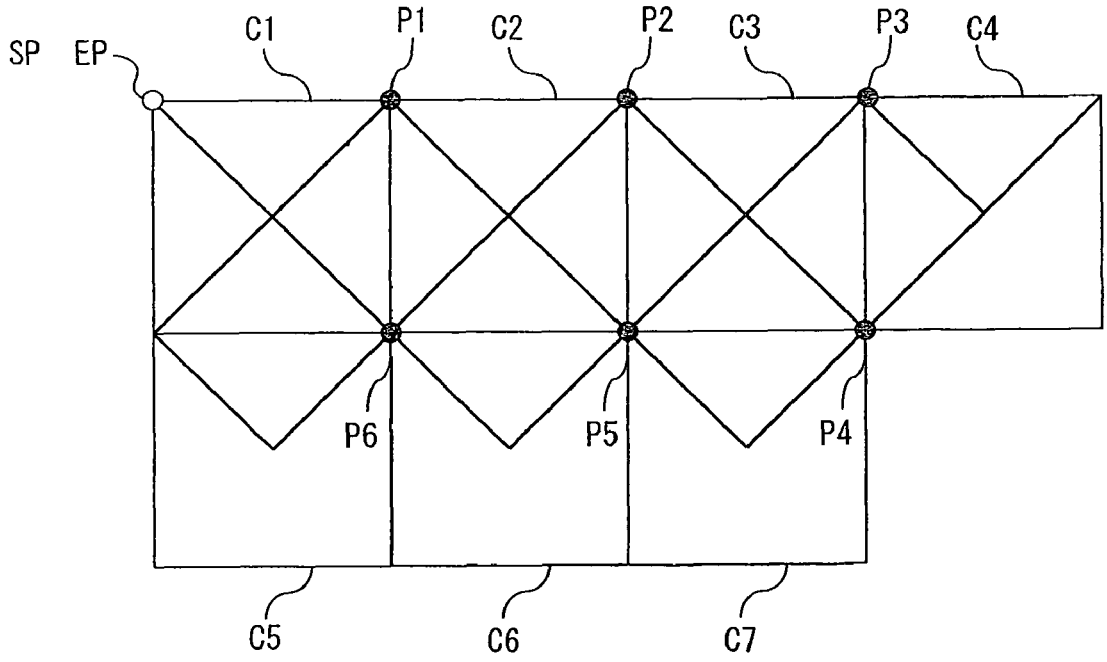
FIG. 21 is an explanatory figure of stitches that are arranged in cross areas C1 to C7 that correspond to a region R4 in FIG. 14.

The method of determining the needle drop points and the stitching order will be explained with reference to FIGS. 21 to 23, using a pattern of stitches that are formed in a region R4 in FIG. 14 as an example. First, an upper left vertex of a cross area C1 that is the farthest to the upper left is set as the stitching starting point (SP) and the stitching ending point (EP). Next, a search is performed for the point of connection between the cross area C and the adjacent cross area, starting with the cross area that is adjacent on the right and moving clockwise. The cross area C1 is connected at a point P1 to a cross area C2 that is adjacent on the right. Next, the cross area C2 is made the center, and the search for the point of connection is performed in the same manner. The cross area C2 is connected at a point P2 to a cross area C3 that is adjacent on the right. Further, the cross area C3 is connected at a point P3 to a cross area C4 that is adjacent on the right.

Next, the search for the point of connection with the cross area C4 is performed, but there is no region adjacent to the right in which a cross-stitch will be formed that continues from the preceding cross-stitch. Proceeding clockwise, there is also no region in which a cross-stitch will be formed to the lower right side that is the next position (the position 2 in FIG. 20) and also not in the next position after that (the position 3 in FIG. 20). Accordingly, the search for the point of connection with the cross area C7, which is the next position in the clockwise direction (the position 4 in FIG. 20), is performed, and a point P4 is found. Once the points of connection have been determined in order in this manner, the tree structure for the cross areas C1 to C7 may be described as shown in FIG. 22. Accordingly, the stitching order for the cross areas C1 to C7 becomes the sequence C1, C2, C3, C4, C7, C6, C5, C6, C7, C4, C3, C2, C1.

Figure 23:
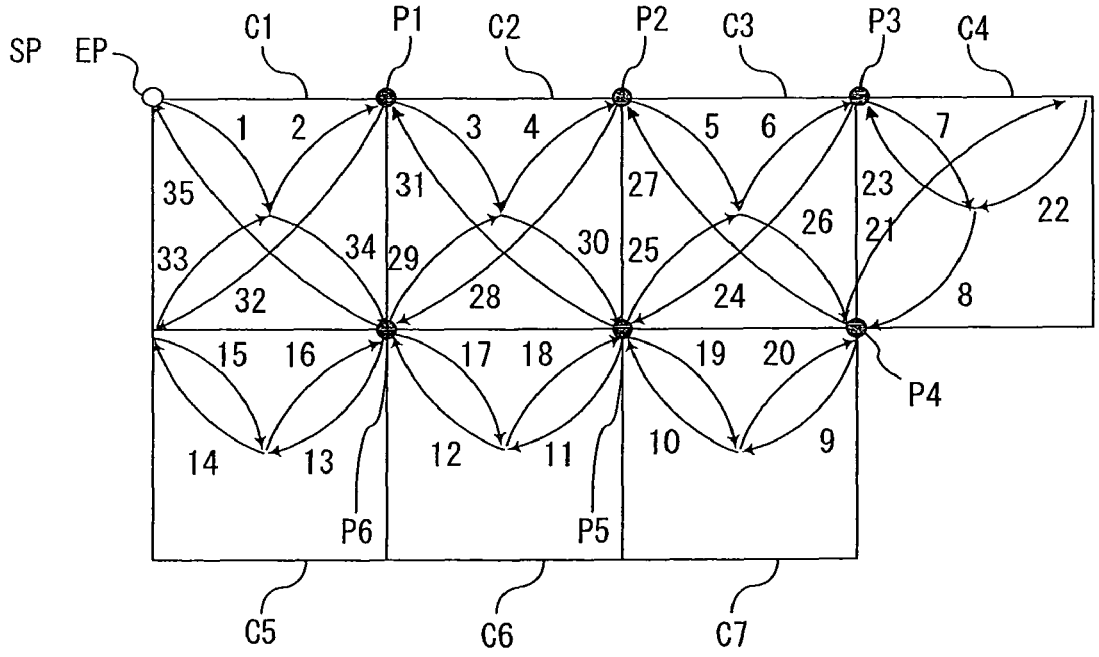
FIG. 23 is an explanatory figure of needle drop points and a stitching order for stitches that are arranged in the cross areas C1 to C7 in FIG. 21.

Therefore, the needle drop points and the stitching order are determined as shown in FIG. 23, in accordance with the basic needle drop points and the basic stitching order that are predetermined according to the number of the quarter cross-stitches that will be formed within the cross areas, as described above. In other words, the needle drop points and the stitching order are determined for the stitches that start from the stitching starting point SP, follow the sequence C1, C2, C3, C4, C7, C6, C5, C6, C7, C4, C3, C2, C1 while passing through the points of connection P1 to P6, and return to the stitching ending point EP.

Figure 24:
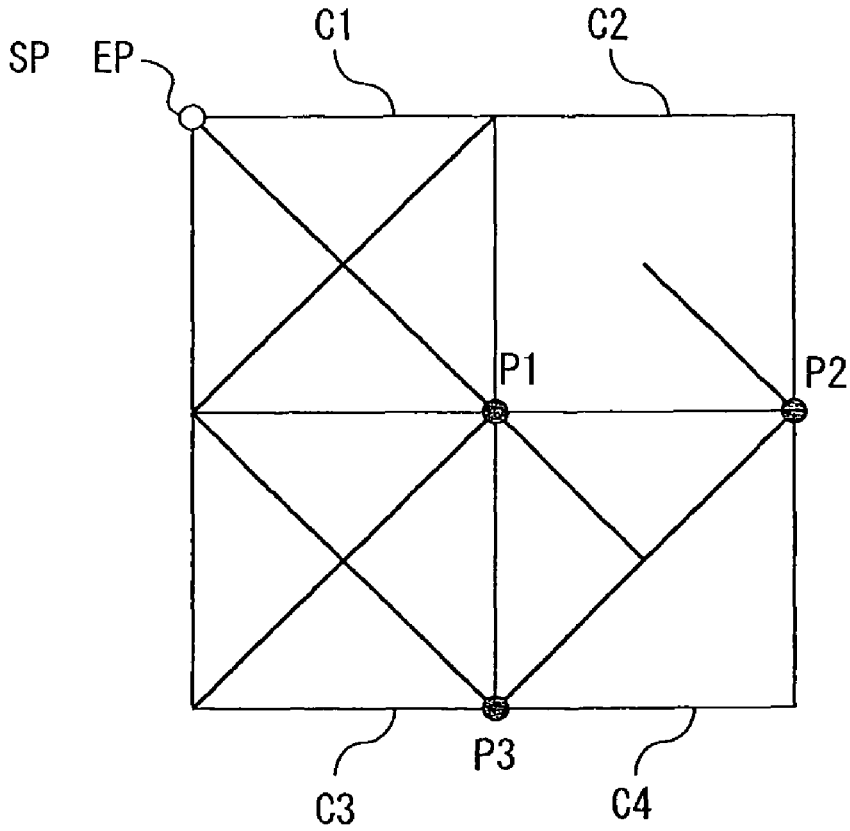
FIG. 24 is an explanatory figure of another example of stitches that are arranged in the cross areas C1 to C4.
Figure 25:
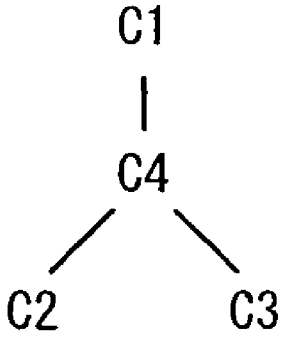
FIG. 25 is an explanatory figure of a tree structure of the cross areas C1 to C4.
Figure 26:
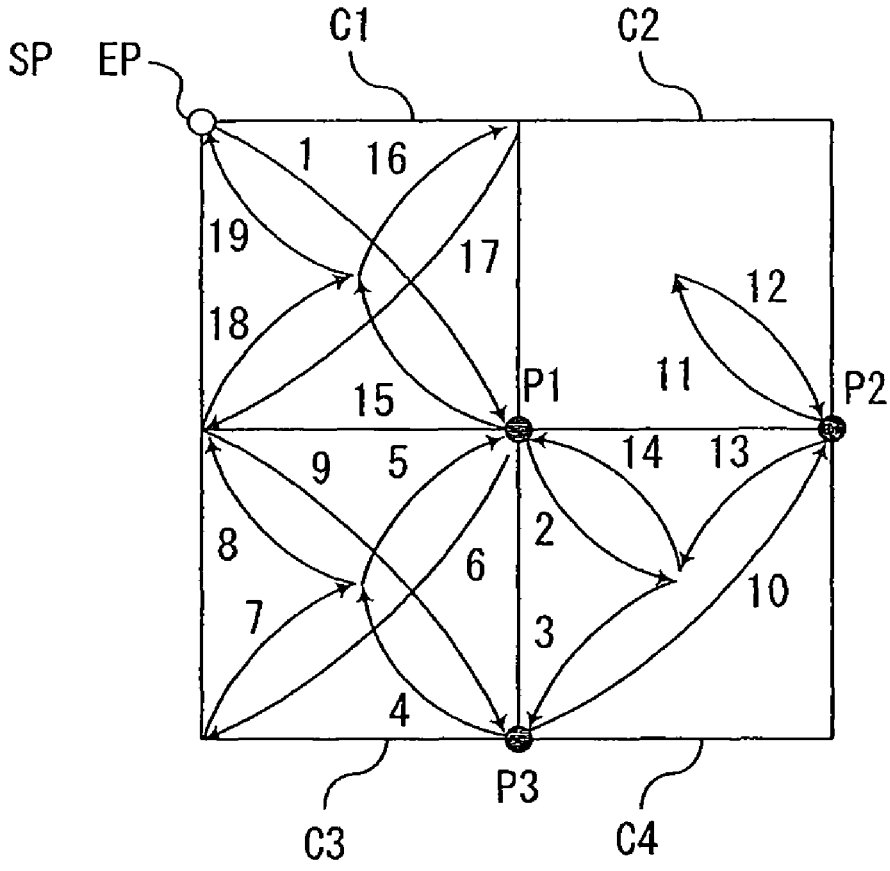
FIG. 26 is an explanatory figure of needle drop points and a stitching order for the stitches that are arranged in the cross areas C1 to C4 in FIG. 24.

The method of determining the needle drop points and the stitching order for an example of a different stitch pattern will be explained with reference to FIGS. 24 to 26. For the stitch pattern that is shown in FIG. 24, a tree structure is generated in which the upper left vertex of the cross area C1 serves as the stitching starting point SP and the stitching ending point EP. First, the search for the point of connection with the cross area C2 that is adjacent on the right is performed, but there is no point of connection. Accordingly, the search for the point of connection with the cross area C4 that is the next position in the clockwise direction is performed, and the point P1 is found. Next, the cross area C4 is made the center, and the search for the point of connection is performed. The search determines that the cross area C4 is connected to the cross areas C3 and C2 at the points P3 and P2, respectively. Accordingly, in this example, the tree structure for the cross areas C1 to C4 branches to C2 and C3 at the cross area C4, as shown in FIG. 25.

In this case, the stitching order for the cross areas C1 to C4 follows a sequence in which some of the stitches are formed in the cross areas C1, C4, C3, a stitch is formed in C4, stitches are formed in C2, with the sequence then returning to C1 via C4. As a whole, the needle drop points and the stitching order are determined as shown in FIG. 26, in accordance with the basic needle drop points and the basic stitching order that are predetermined according to the number of the quarter cross-stitches that will be formed within the cross areas, starting from the stitching starting point SP in C1, following the sequence C1, C4, C3, C4, C2, C4, C1, and returning to the stitching ending point EP in C1.

The embroidery data may be generated in the manner that is described above, based on the arrangement of cross-stitches that is determined by the stitch determination processing. In a case where the embroidery pattern will be sewn using embroidery threads in a plurality of colors, a color may be set for each of the unit line segments on which it is determined that a stitch will be formed. The needle drop points and the stitching order may then be determined as described above for each group of the unit line segments that have the same color.

The embroidery data that are generated by the embroidery data generating device 1 are stored in the memory card 115 through the memory card connector 23. The embroidery data are then supplied to the embroidery sewing machine 3 by mounting the memory card 115 in the memory card slot 37. The embroidery pattern is then sewn in the form of the cross-stitches by the controlling of the operations of the needle bar 35 and the like based on the embroidery data that have been supplied from the memory card 115.

As explained above, according to the embroidery data generating device 1 in the present embodiment, the cross areas 300, in which the two line segments that serve as the base for the stitches of the cross-stitch are the diagonal lines, are arranged contiguously over the entire closed region. Further, each of the cross areas 300 is divided into the four divided areas 301 to 304, each of which includes the unit line segments 31 to 34. The determinations are then made as to whether a stitch (a quarter cross-stitch) will be formed on the unit line segment in each of the divided areas 301 to 304. In other words, the divided areas are arranged contiguously over the entire closed region. Furthermore, for each of the divided areas, the determination is made as to whether the stitches will be formed. Once the determinations have been made as to whether a stitch will be formed in the divided areas 301 to 304 in all of the cross areas 300, the embroidery data that indicate the needle drop points and the stitching order are generated based on the coordinate data for the endpoints of the unit line segments on which it has been determined that the stitches will be formed.

Thus the determinations as to whether the stitches will be formed are not made for one X-shaped whole cross-stitch at a time, but for one-fourth of the whole cross-stitch at a time. Therefore, the jaggedness of the contour line of the embroidery pattern that is formed may be reduced, and the embroidery data that faithfully represent the outline of the original form may be generated.

Hereinafter, another embodiment of the main processing that is performed by the embroidery data generating device 1 will be explained with reference to FIGS. 27 to 32. The main processing for generating the embroidery data that is shown in FIG. 27 is performed by the CPU 11 in accordance with the embroidery data generating program that is stored in the program storage area 152 of the HDD 15.

Figure 27:
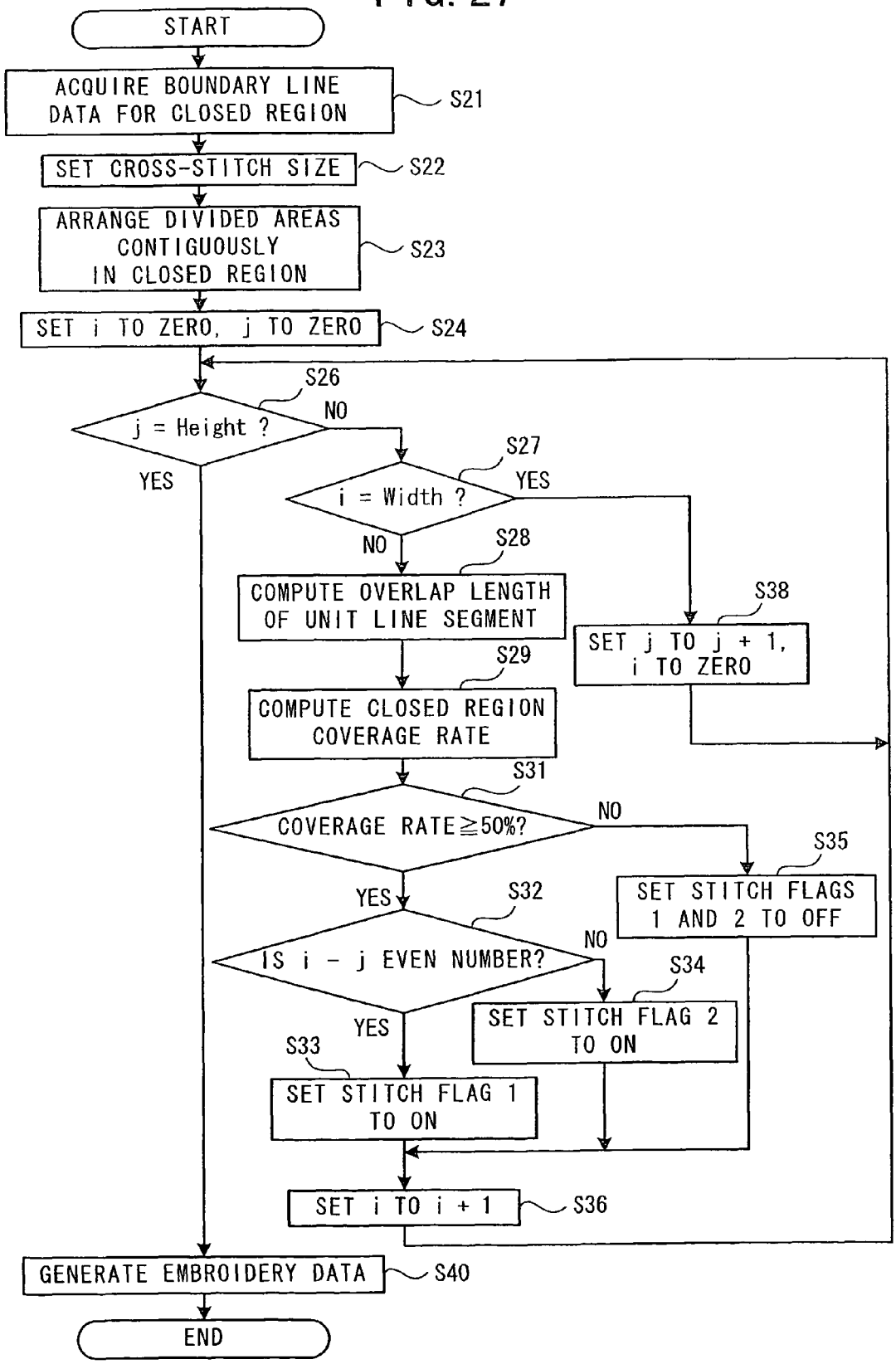
FIG. 27 is a flowchart of main processing in another embodiment of the embroidery data generating device.
Figure 28:
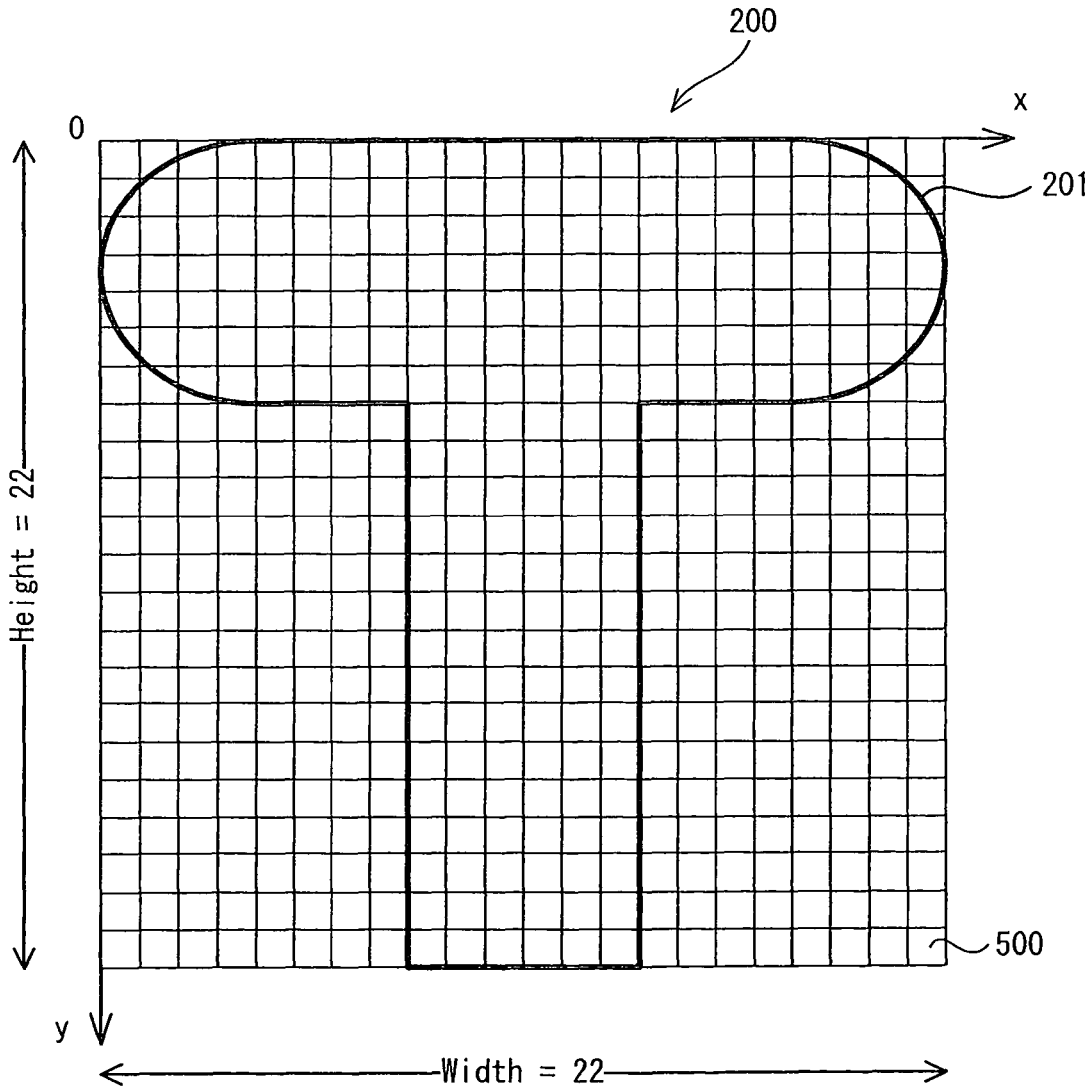
FIG. 28 is an explanatory figure of cross areas that are arranged contiguously in a coordinate system in which a closed region is shown, in the other embodiment.
Figure 31:
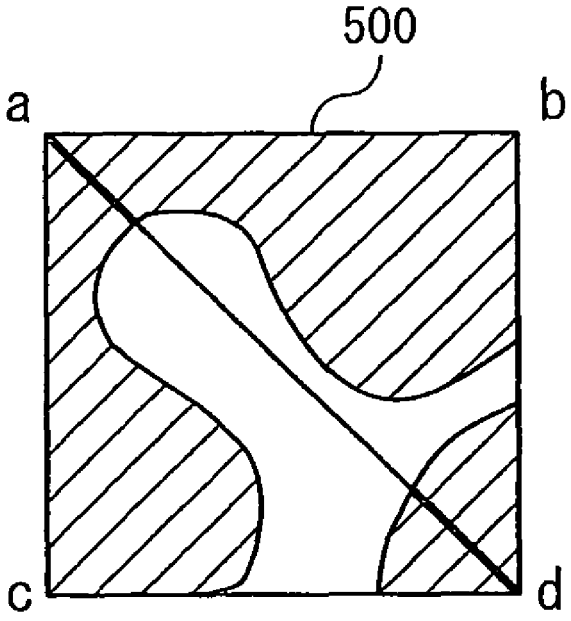
FIG. 31 is an explanatory figure of an example of a divided area for which a closed region coverage rate is determined.

When the main processing that is shown in FIG. 27 is started, first, the boundary line data for the closed region are acquired (Step S21), and the size of the cross-stitches is set (Step S22). The processing at Step S21 and Step 22 is the same as in the embodiment that is described above, so an explanation will be omitted (refer the Steps S1 and S2 in FIG. 7). Next, divided areas 500 are arranged contiguously in a coordinate system in which the closed region is shown (Step S23). In the embodiment that is described above, the cross areas 300 are arranged contiguously at this stage. Then the cross areas 300 are processed one at a time, and each of the cross areas 300 is divided into the four divided areas 301 to 304. Thus the divided areas are arranged contiguously over the entire closed region. In contrast, at this stage in the present embodiment, the size of the divided areas 500 is determined, and the all of the divided areas 500 are arranged contiguously.

Specifically, the length of one side of the cross area 300, which is a square, is determined based on the cross-stitch size that was set at Step S22, and the length of one side of the divided area 500, which is a square, is set to one-half of the length of one side of the cross area 300. Next, a vertex of one of the divided areas 500 is located at the origin point O (0, 0), and the divided areas 500 are arranged contiguously, without any gaps between the divided areas 500. Then a divided area table 61 (refer to FIG. 29) and a divided area layout table 62 (refer to FIG. 30) are generated and are stored in a specified storage area of the RAM 12.

As shown in FIG. 29, the divided area table 61 that is generated in the present embodiment is similar to the divided area table 53 (refer to FIG. 13) that is generated in the embodiment that is described above. However, the divided area table 61 differs from the divided area table 53 in that there is no item for the cross area number and there are two types of stitch flags (stitch flags 1 and 2). The reason why there is no cross area number is because, in the present embodiment, from the start, only the divided areas 500 are arranged in the coordinate system in which the closed region is shown, as described above. The reason why there are the two stitch flags is in order to identify the direction of the unit line segment in the divided area 500, that is, to identify whether it is a diagonal line that connects the upper left vertex and the lower right vertex or a diagonal line that connects the upper right vertex and the lower left vertex. When the divided area table 61 is generated at Step S23, the initial values of the stitch flags 1 and 2 are both set to OFF.

As shown in FIG. 30, the divided area layout table 62 that is generated in the present embodiment is similar to the cross area layout table 52 (refer to FIG. 12) that is generated in the embodiment that is described above. In other words, the divided area layout table 62 is a table in which, for example, a column item is defined as i and a row item is defined as j and which shows the layout of the divided areas 500. The number of the column items i that are provided is equal to the number of the divided areas 500 that were arranged in the x axis direction at Step S23 (22 in the example in FIG. 28), although not all of them are shown in FIG. 30. The number of the row items j that are provided is equal to the number of the divided areas 500 that were arranged in the y axis direction at Step S23 (22 in the example in FIG. 28). In a cell that is indicated by i and j, a divided area number of the divided area 500 in that position in the coordinate system is stored.

Next in the main processing in FIG. 27, a value i of an x direction counter and a value j of a y direction counter for processing in order the contiguously arranged divided areas 500 are both set to an initial value of zero (0) (Step S24). Next, a determination is made as to whether the counter value j is equal to Height, which is a value that indicates the number of the divided areas 500 that are arranged in the y axis direction (Step S26). In the example in FIG. 28, Height is 22. The first time the processing is performed, the counter value j is zero, so is not equal to Height (NO at Step S26). In other words, in the y axis direction, there is an unprocessed divided area 500 remaining. Accordingly, a determination is made as to whether the counter value i is equal to Width, which is a value that indicates the number of the divided areas 500 that are arranged in the x axis direction (Step S27). In the example in FIG. 28, Width is 22. The first time the processing is performed, the counter value i is zero, so is not equal to Width (NO at Step S27). In other words, in the x axis direction, there is an unprocessed divided area 500 remaining.

Accordingly, the coordinate data for the divided area 500 that is the target of the processing are acquired from the divided area table 61. The first time that the processing is performed, the counter values i and j are both zero. Therefore, the divided area layout table 62 is referenced, and the divided area 500 for which the divided area number is zero is specified as the target of the processing. Accordingly, the coordinate data for the vertices a to d of the divided area 500 that corresponds to the divided area number zero are read out from the divided area table 61.

Next, the closed region coverage rate is computed that is the percentage of the divided area that is covered by the closed region. In the present embodiment, a ratio of the length of the portion of the unit line segment in the divided area 500 that overlaps the closed region is used in the computing of the closed region coverage rate. The length of the portion of the unit line segment in the divided area 500 that overlaps the closed region is hereinafter referred to as the "overlap length."

First, the overlap length of the unit line segment is computed (Step S28). The unit line segment in the divided area 500 is a diagonal line with a specified direction. Specifically, in the divided area 500 in which the upper left vertex is positioned at the origin point O (0, 0), the diagonal line that connects the upper left vertex a and the lower right vertex d becomes the unit line segment. In the divided area 500 that is adjacent on the right, the diagonal line that connects the upper right vertex b and the lower left vertex c becomes the unit line segment. In the divided area 500 that is immediately below the divided area 500 in which the upper left vertex is positioned at the origin point O (0, 0), the diagonal line that connects the upper right vertex b and the lower left vertex c becomes the unit line segment. In the divided area 500 that is adjacent on the right of that divided area 500, the diagonal line that connects upper left vertex a and the lower right vertex d becomes the unit line segment.

In other words, because of the regularity of the arrangement of the divided areas 500, the directions of the unit line segments are set as one of the two types described above, depending on whether the difference between the value i of the x direction counter and the value j of the y direction counter is an odd number or an even number. Accordingly, the vertex that defines the unit line segment of the divided area 500 that is the target of the processing may be identified by referring to the divided area layout table 62 for the divided area 500 that is the target of the processing. Therefore, the coordinates of the point of intersection between the boundary line of the closed region and the unit line segment in the divided area 500 that is the target of the processing may be determined based on the coordinates of the boundary line of the closed region and on the coordinates of the vertex of the divided area 500 that are stored in the divided area table 61. The overlap length for the unit line segment in the divided area 500 that is the target of the processing may then be determined based on the coordinates of the point of intersection.

Once the overlap length of the unit line segment has been computed (Step S28), the closed region coverage rate is computed (Step S29). Specifically, the length of the unit line segment is computed based on the length of one side of the divided area 500 that was set at Step S22 of the main processing. The closed region coverage rate is then computed by dividing the overlap length of the unit line segment in the divided area 500 by the length of the unit line segment.

Next, a determination is made as to whether the computed closed region coverage rate is greater than or equal to 50% (Step S31). If it is determined that the closed region coverage rate is greater than or equal to 50% (YES at Step S31), a quarter cross-stitch will be formed on the unit line segment. Accordingly, in order to determine the direction in which the stitch will be formed, a determination is made as to whether or not the difference between the value i of the x direction counter and the value j of the y direction counter is an even number (Step S32). For example, the first time that the processing is performed, the counter values i and j are both zero, so the difference is an even number (YES at Step S32). In this case, the stitch flag 1 is set to ON, and the stitch will be formed on the unit line segment that is the diagonal line that connects the upper left vertex a and the lower right vertex d (Step S33).

On the other hand, if the difference between the value i of the x direction counter and the value j of the y direction counter is an odd number (NO at Step S32), the stitch flag 2 is set to ON, and the stitch will be formed on the unit line segment that is the diagonal line that connects the upper right vertex b and the lower left vertex c (Step S34). If it is determined that the closed region coverage rate is neither greater than nor equal to 50% (NO at Step S31), both of the stitch flags 1 and 2 are set to OFF, and it is determined that no stitch will be formed in the divided area 500 (Step S35).

The determination as to whether the stitch will be formed may differ, depending on whether the closed region coverage rate is computed based on the surface area that is covered by the closed region, as in the embodiment that is described above, or whether the closed region coverage rate is computed based on the overlap length of the unit line segment, as in the present embodiment. This point will be explained with reference to FIGS. 31 and 32. For example, in some cases, like that shown in FIG. 31, the surface area in the divided area 500 that is covered by the closed region (the shaded portion) is large, but the overlap length (the thick portion) on the unit line segment ad is short. In this sort of case, in a case where the closed region coverage rate that is based on the covered surface area is used, it will be determined that the quarter cross-stitch will be formed on the unit line segment ad in the divided area 500. In contrast, in a case where the closed region coverage rate that is based on the overlap length is used, it will be determined that the quarter cross-stitch will not be formed.

Figure 32:
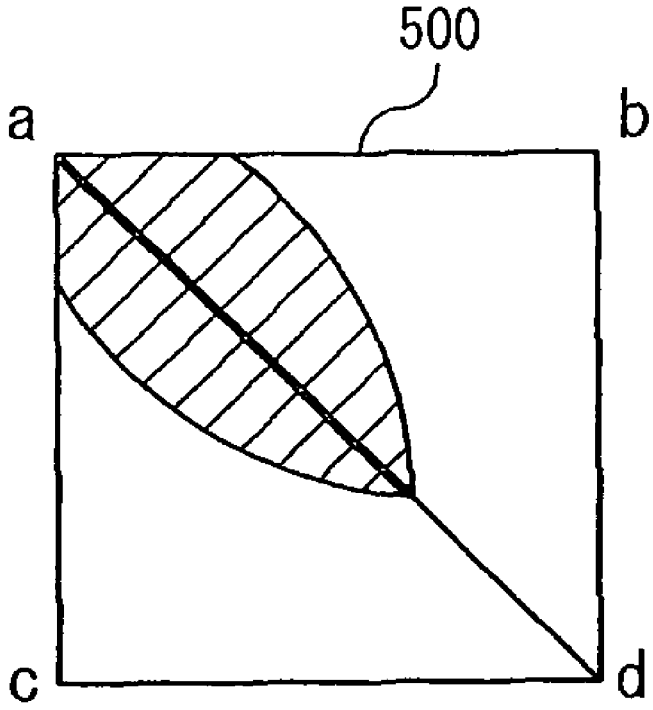
FIG. 32 is an explanatory figure of another example of a divided area for which a closed region coverage rate is determined.

There may be cases, like that shown in FIG. 32, in which the surface area in the divided area 500 that is covered by the closed region (the shaded portion) is small, but the overlap length (the thick portion) on the unit line segment ad is long. In this sort of case, in a case where the closed region coverage rate that is based on the covered surface area is used, it will be determined that the quarter cross-stitch will not be formed. In contrast, in a case where the closed region coverage rate that is based on the overlap length is used, it will be determined that the quarter cross-stitch will be formed.

These examples indicate that in a case where the closed region coverage rate is computed based on the surface area that is covered by the closed region, a quarter cross-stitch may be formed that reflects an expanse of the closed region in relation to the divided area 500. In a case where the closed region coverage rate is computed based on the overlap length of the unit line segment, a quarter cross-stitch may be formed that reflects a degree of congruence between the unit line segment and the shape of the closed region. In both cases, it is easy to compute the surface area and the length using a known computation method. It is therefore possible to determine efficiently whether a quarter cross-stitch will be formed in each of the divided areas 500.

In the main processing in FIG. 27, once it has been determined, at one of Steps 33, 34, and 35, whether the stitch will be formed, as described above, 1 is added to the value i of the x direction counter (Step S36). The processing then returns to Step S26, and the same sort of processing is repeated. The twenty-second time the processing is performed, once the processing has been completed for all of the divided areas 500 that are arranged in the same row in the x axis direction, the counter value i becomes 22 at Step S36. Accordingly, the next time that the processing at Step S26 is performed, it will be determined that the counter value i is equal to Width (YES at Step S27). In this case, that means that the processing has been completed for one row's worth of the divided areas 500 that are arranged in the x axis direction. Therefore, in order to shift to the processing of the next row of the divided areas 500, 1 is added to the value j of the y direction counter, such that the value j becomes. 1, and the value i of the x direction counter is reset to the initial value of zero (Step S38).

In the same manner, the processing of the divided areas 500 is performed in order, moving to the right (the positive direction) along the x axis, and when the processing of the entire row has been completed, a shift is made to the next row in the downward direction (the positive direction) along the y axis, and the processing is repeated. Then, when the processing has been completed for the twenty-second row, the value j of the y direction counter is set to 22 at Step S38. Accordingly, at the next Step S26, it is determined that the counter value j is equal to Height (YES at Step S26). In this case, for each of the divided areas 500 that are arranged in the coordinate system for the closed region, the determination has been made as to whether the quarter cross-stitch will be formed, so the arrangement of the cross-stitches that will configure the embroidery pattern has been determined. Therefore, the embroidery data generation processing is performed (Step S40), and the main processing is terminated. In the present embodiment, four divided areas 500 are equivalent to a cross area 300 in the embodiment that was described above, so the divided areas 500 may also be aggregated into groups such that a group includes four divided areas 500, and the embroidery data may then be generated in the same manner as in the embodiment that was described above.

In the main processing of the embroidery data generating device 1 in the present embodiment, in a case where the processing that is described above has been performed with the closed region 200 in FIG. 9 as the original form, the arrangement of the cross-stitches is set as shown in FIG. 14 in the same manner as in the embodiment that was described above.

As explained above, according to the embroidery data generating device 1 in the present embodiment, the divided areas 500 are arranged contiguously over the entire closed region. The divided area 500 is one-fourth of the cross area 300 in which the diagonal lines serve as the two line segments that are the base for the stitching of the cross-stitch, and each of the divided areas 500 includes a unit line segment. For each of the divided areas 500, the determination is made as to whether the stitch (the quarter cross-stitch) will be formed on the unit line segment. Once the determinations as to whether the stitches will be formed have been made for all of the divided areas 500, the embroidery data that indicate the needle drop points and the stitching order are generated based on the coordinate data for the endpoints of the unit line segments on which it has been determined that the stitches will be formed.

Thus, in the present embodiment as well, the determinations as to whether the stitches will be formed are not made for one X-shaped whole cross-stitch at a time, but for one-fourth of the whole cross-stitch at a time. Therefore, the jaggedness of the contour line of the embroidery pattern that is formed may be reduced, and the embroidery data that faithfully represent the outline of the original form may be generated.

The embroidery data generating device according to the present disclosure is not limited to the embodiments that are described above, and it is obvious that various modifications may be applied within the scope of the present disclosure. For example, in the embodiments that are described above, a personal computer is used as the embroidery data generating device 1. However, the embroidery data generating program may be stored in the embroidery sewing machine 3, and the embroidery data may be generated in the embroidery sewing machine 3. At this time, the boundary line data for the closed region may be input from the outside through the memory card 115. Data on a contour line of an embroidery pattern that is stored beforehand in the embroidery sewing machine 3 may be used.

In the embodiments that are described above, the closed region coverage rate in each of the divided areas is determined based on the coordinate data for the boundary line of the closed region. However, in a case where image data for the closed region are stored in the embroidery data generating device 1, the closed region coverage rate may be determined based on the number of pixels that are in the closed region within each of the divided areas. In a case where the determination as to whether the stitch will be formed is made based on the closed region coverage rate, it is possible to use both the coverage rate that is based on the surface area and the coverage rate that is based on the overlap length. In this case, it may be determined that the stitch will be formed in the divided area in a case where both the coverage rate that is based on the surface area and the coverage rate that is based on the overlap length are not less than 50%, for example. The 50% threshold value for the coverage rate may be varied as desired.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data generating apparatus that generates embroidery data for an embroidery pattern, the embroidery data generating apparatus comprising:

a boundary line acquisition device that acquires boundary line data that is data that specifies a boundary line that surrounds a closed region that has a shape;

a unit area arrangement device that contiguously arranges first unit areas over the entire closed region that is specified by the boundary line data that is acquired by the boundary line acquisition device, each of the first unit areas being a rectangular area that is obtained by dividing a second unit area into fourths and that includes a unit line segment as a diagonal line of the rectangular area, the second unit area being a rectangular area in which two line segments that intersect one another at a midpoint of each of the two line segments serve as diagonal lines and defining an area for a cross-stitch, the unit line segment extending from an intersection of the two line segments to one of endpoints of the two line segments;

a coverage rate computation device that computes a coverage rate that is a ratio of the closed region in each of the first unit areas that are arranged by the unit area arrangement device;

a determination device that determines whether a stitch will be formed on the unit line segment in each of the first unit areas, based on the coverage rate that is computed by the coverage rate computation device;

an embroidery data generating device that generates the embroidery data for the embroidery pattern that is formed by a plurality of cross-stitches based on a determination by the determination device, each of the cross-stitches including at least one stitch formed on at least one of a plurality of unit line segments included in four of the first unit areas obtained from the second unit area;

an overlap computation device that computes an overlap length that is a length of a portion of the unit line segment that overlaps the closed region in each of the first unit areas; and an overlap rate computation device that computes, as the coverage rate, a ratio of the overlap length that is computed by the overlap computation device in relation to a length of the unit line segment.

2. The embroidery data generating apparatus according to claim 1, wherein the coverage rate computation device includes:

a surface area computation device that computes a covered surface area that is a surface area that is covered by the closed region in each of the first unit areas; and a surface area rate computation device that computes, as the coverage rate, a ratio of the covered surface area that is computed by the surface area computation device in relation to a surface area of each of the first unit areas.

3. A non-transitory computer-readable medium storing an embroidery data generating program that generates embroidery data for an embroidery pattern, the program comprising instructions that cause a computer to perform the steps of:

acquiring boundary line data that is data that specifies a boundary line that surrounds a closed region that has a shape;

arranging contiguously first unit areas over the entire closed region that is specified by the acquired boundary line data, each of the first unit areas being a rectangular area that is obtained by dividing a second unit area into fourths and that includes a unit line segment as a diagonal line of the rectangular area, the second unit area being a rectangular area in which two line segments that intersect one another at a midpoint of each of the two line segments serve as diagonal lines and defining an area for a cross-stitch, the unit line segment extending from an intersection of the two line segments to one of endpoints of the two line segments;

computing a coverage rate that is a ratio of the closed region in each of the first unit areas;

determining whether a stitch will be formed on the unit line segment in each of the first unit areas, based on the computed coverage rate;

generating the embroidery data for the embroidery pattern that is formed by a plurality of cross-stitches based on a determination of whether a stitch will be formed on the unit line segment in each of the first unit areas, each of the cross-stitches including at least one stitch formed on at least one of a plurality of unit line segments included in four of the first unit areas obtained from the same second unit area;

computing an overlap length that is a length of a portion of the unit line segment that overlaps the closed region in each of the first unit areas; and computing, as the coverage rate, a ratio of the computed overlap length in relation to a length of the unit line segment.

4. The non-transitory computer-readable medium according to claim 3, wherein the step of computing of the coverage rate includes the steps of:

computing a covered surface area that is a surface area that is covered by the closed region in each of the first unit areas; and computing, as the coverage rate, a ratio of the computed covered surface area in relation to a surface area of each of the first unit areas.

5. An embroidery data generating apparatus that generates embroidery data for an embroidery pattern, the embroidery data generating apparatus comprising:

boundary line acquisition means for acquiring boundary line data that is data that specifies a boundary line that surrounds a closed region that has a shape;

unit area arrangement means for contiguously arranging first unit areas over the entire closed region that is specified by the boundary line data that is acquired by the boundary line acquisition means, each of the first unit areas being a rectangular area that is obtained by dividing a second unit area into fourths and that includes a unit line segment as a diagonal line of the rectangular area, the second unit area being a rectangular area in which two line segments that intersect one another at a midpoint of each of the two line segments serve as diagonal lines and defining an area for a cross-stitch, the unit line segment extending from an intersection of the two line segments to one of endpoints of the two line segments;

coverage rate computation means for computing a coverage rate that is a ratio of the closed region in each of the first unit areas that are arranged by the unit area arrangement means;

determination means for determining whether a stitch will be formed on the unit line segment in each of the first unit areas, based on the coverage rate that is computed by the coverage rate computation means;

embroidery data generating means for generating the embroidery data for the embroidery pattern that is formed by a plurality of cross-stitches based on a determination by the determination means, each of the cross-stitches including at least one stitch formed on at least one of a plurality of unit line segments included in four of the first unit areas obtained from the second unit area;

overlap computation means for computing an overlap length that is a length of a portion of the unit line segment that overlaps the closed region in each of the first unit areas; and overlap rate computation means for computing, as the coverage rate, a ratio of the overlap length that is computed by the overlap computation means in relation to a length of the unit line segment.

6. The embroidery data generating apparatus according to claim 5, wherein the coverage rate computation means include:

surface area computation means for computing a covered surface area that is a surface area that is covered by the closed region in each of the first unit areas; and surface area rate computation means for computing, as the coverage rate, a ratio of the covered surface area that is computed by the surface area computation means in relation to a surface area of each of the first unit areas.

* * * * *